US008290776B2

(12) United States Patent
Moriwaki et al.

(10) Patent No.: US 8,290,776 B2
(45) Date of Patent: Oct. 16, 2012

(54) MEETING VISUALIZATION SYSTEM

(75) Inventors: Norihiko Moriwaki, Hino (JP); Nobuo Sato, Saitama (JP); Tsuneyuki Imaki, Kawasaki (JP); Toshihiko Kashiyama, Kokubunji (JP); Itaru Nishizawa, Koganei (JP); Masashi Egi, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 1041 days.

(21) Appl. No.: 12/078,520

(22) Filed: Apr. 1, 2008

(65) Prior Publication Data

US 2008/0255847 A1 Oct. 16, 2008

(30) Foreign Application Priority Data

Apr. 12, 2007 (JP) ..... 2007-105004

(51) Int. Cl.
*G10L 11/00* (2006.01)

(52) U.S. Cl. ..... 704/270; 704/200; 704/270.1

(58) Field of Classification Search ..... 704/201, 704/270, 270.1; 709/206
See application file for complete search history.

(56) References Cited

U.S. PATENT DOCUMENTS 7,298,930 B1 * 11/2007 Erol et al. ..... 382/305
2002/0063726 A1 * 5/2002 Jouppi ..... 345/660
2004/0021765 A1 * 2/2004 Kubala et al. ..... 348/14.08
2008/0189624 A1 * 8/2008 Chotai et al. ..... 715/753
2009/0046139 A1 * 2/2009 Cutler et al. ..... 348/14.08

FOREIGN PATENT DOCUMENTS

JP 2004-046680 7/2002
JP 2005-202035 1/2004

OTHER PUBLICATIONS

Bett et al.,(2000), "Multimodal Meeting Tracker", 13 pages, Interactive Systems Laboratories, Carnegie Mellon University, Pittsburgh, PA.*

(Continued)

*Primary Examiner* — Angela A Armstrong
(74) *Attorney, Agent, or Firm* — Stites & Harbison, PLLC; Juan Carlos A. Marquez, Esq.

(57) ABSTRACT

Voice of plural participants during a meeting is obtained and dialogue situations of the participants that change every second are displayed in real time, so that it is possible to provide a meeting visualization system for triggering more positive discussions. Voice data collected from plural voice collecting units associated with plural participants is processed by a voice processing server to extract speech information. The speech information is sequentially input to an aggregation server. A query process is performed for the speech information by a stream data processing unit of the aggregation server, so that activity data such as the accumulation value of speeches of the participants in the meeting is generated. A display processing unit visualizes and displays dialogue situations of the participants by using the sizes of circles and the thicknesses of lines on the basis of the activity data.

4 Claims, 17 Drawing Sheets

OTHER PUBLICATIONS

Colbath et al, ("Rough 'n' Ready: A Meeting Recorder and Browser", In: Proceedings of the Perceptual User Interface Conference, San Francisco, CA, Nov. 1998, pp. 220-223 (1998).*

Mathew Laibowitz, et al., "A Sensor Network for Social Dynamics", 5th International Conference on Information Processing in Sensor Networks (IPSN), (Apr. 2006); pp. 483-491.

Joan Morris DiMicco, et al., "Using Visualizations to Review a Group's Interaction Dynamics," Conference on Human Factors in Computing Systems (CHI), (Apr. 2006); (6 pages).

Peter A. Gloor, et al., "Studying Microscopic Peer-to-Peer Communication Patterns," Americas Conference on Information Systems (AMCIS), (Aug. 2007) (12 pages).

Daniel Olguin Olguin, et al., "Wearable Communicator Badge: Designing a New Platform for Revealing Organizational Dynamics," IEEE 10th International Symposium on Wearable Computing (Doctoral Colloquium Proceedings), Montreaux, Switzerland (Oct. 2006) (3 pages).

* cited by examiner

SCHEMA REGISTRATION

```
REGISTER STREAM voice (id INT, energy DOUBLE)
REGISTER STREAM offset (id INT, value DOUBLE)
REGISTER STREAM participants (id INT, name VARCHAR)
REGISTER STREAM motion (name VARCHAR, intensity DOUBLE)
REGISTER STREAM statement (name VARCHAR, words VARCHAR)
```

FIG.10

1000

```
REGISTER QUERY activity AS
 RSTREAM [3 sec](
  SELECT SUM (energy) AS value
   FROM voice [RANGE 30 sec]
```

1010

1011

```
REGISTER QUERY recent_sequence_count AS
  SELECT COUNT(*) AS cnt
   FROM speech_sequences [RANGE 30 sec]
```

1012

```
REGISTER QUERY recent_speakers_count AS
  SELECT COUNT (DISTINCT name) AS cnt
   FROM start_speech [RANGE 30 sec]
```

1013

```
REGISTER QUERY activity AS
 RSTREAM [3 sec](
  SELECT
 (recent_sequences_count.cnt +1/(1+recent_sequences_count.cnt))
      * recent_speakers_count.cnt AS value
   FROM recent_sequences_count, recent_speakers_count)
```

1020

1021

```
REGISTER QUERY speakers_motion AS
 ISTREAM(
  SELECT motion/intensity
   FROM speech,motion [NOW]
   WHERE speech.name=motion.name)
```

1022

```
REGISTER QUERY activity AS
 RSTREAM [3 sec](
  SELECT SUM (intensity) AS value
   FROM speakers_motion [RANGE30 sec])
```

MEETING VISUALIZATION SYSTEM

CLAIM OF PRIORITY

The present application claims priority from Japanese application JP 2007-105004 filed on Apr. 12, 2007, the content of which is hereby incorporated by reference into this application.

BACKGROUND OF THE INVENTION

1. Field of the Invention

The present invention relates to a meeting visualization technique by which voice data is collected and analyzed in a meeting or the like where plural members gather, so that interaction situations among the members are displayed in real time.

2. Description of the Related Art

Methods of improving the productivity and creativity of knowledge workers have attracted attention. In order to create a new idea and knowledge, it is important that experts in different fields gather to repeat discussions. Among the methods, a methodology called knowledge management has attracted attention as a method of sharing and managing wisdoms of individuals as assets of an organization. The knowledge management is a concept including a reform of an organization's culture and climate, and software called a knowledge management support tool has been developed and sold as a support tool for sharing knowledge by using the information technology. Many of the knowledge management support tools currently sold are centered on a function for efficiently managing documents prepared in an office. There is also another tool produced by focusing on a lot of knowledge that lies in communications among members in an office. JP-A 2005-202035 discloses a technique by which the situations of dialogues made between members of an organization are accumulated. Further, there has been developed a tool for facilitating exhibition of knowledge by providing an electronic communication field. JP-A 2004-046680 discloses a technique by which effects among members are displayed by using a result obtained by comparing counts of the number of sent or received electronic mails in terms of electronic interactions.

BRIEF SUMMARY OF THE INVENTION

In order to create a new idea and knowledge, it is important that experts in different fields gather to repeat discussions. In addition, a process of a fruitful discussion in which a finite period of time is effectively used is important. A conventional knowledge management tool focuses on information sharing of the results of the discussions rather than the process of the discussions. JP-A 2005-202035 aims at recreating the situations of accumulated dialogues by participants or someone other than the participants, and does not focus on a process itself of the dialogues. In JP-A 2004-046680, an effect extent among members is calculated based on a simple value that is the number of sent or received electronic mail, however, the effect extent is not calculated in consideration of a process of discussions. In addition, interactions using electronic mails are not generally suitable for deep discussions. Even if an electronic interaction technique such as a tele-conference system with high definition is sufficiently developed, it does not completely replace face-to-face discussions. For creation of knowledge in an office, face-to-face conversations and meetings without interposing electronic media are necessary.

The present invention relates to an information processing system for facilitating and triggering the creation of an idea and knowledge in a meeting or the like where plural members gather. Voice generated during a meeting is obtained and a speaker, the number of speeches, a dialogue sequence, and the activity degree of the meeting are calculated to display the situations of the meeting that change every second in real time. Accordingly, the situations are fed back to participants themselves, and it is possible to provide a meeting visualization system for triggering more positive discussions.

In order to achieve the object, the present invention provides a meeting visualization system which visualizes and displays dialogue situations among plural participants in a meeting, including: plural voice collecting units which are associated with the participants; a voice processing unit which processes voice data collected from the voice collecting units to extract speech information; a stream processing unit to which the speech information extracted by the voice processing unit is sequentially input and which performs a query process for the speech information so as to generate activity data of the participants in the meeting; and a display processing unit which visualizes and displays the dialogue situations of the participants on the basis of this activity data.

According to the present invention, by performing a predetermined process for voice data, a speaker, and the number of speeches and dialogues of the speaker are specified, so that the number of speeches and dialogues are displayed in real time by using the size of a circle and the thickness of a line, respectively. Further, discussion contents obtained from key stroke information, the accumulation of speeches for each speaker, and an activity degree are displayed at the same time.

According to the present invention, members make discussions while the situations of the discussions are grasped in real time, so that the situations are fed back to prompt a member who makes fewer speeches to make more speeches. Alternatively, a mediator of the meeting controls the meeting so that more participants provide ideas while grasping the situations of the discussions in real time. Accordingly, activation of discussions and effective creation of knowledge can be expected.

BRIEF DESCRIPTION OF THE DRAWINGS

FIG. 10 is a diagram for explaining a configuration for realizing the activity data generation process according to the second embodiment;

DETAILED DESCRIPTION OF THE INVENTION

Hereinafter, embodiments of the present invention will be described on the basis of the accompanying drawings.

First Embodiment

Figure 3:
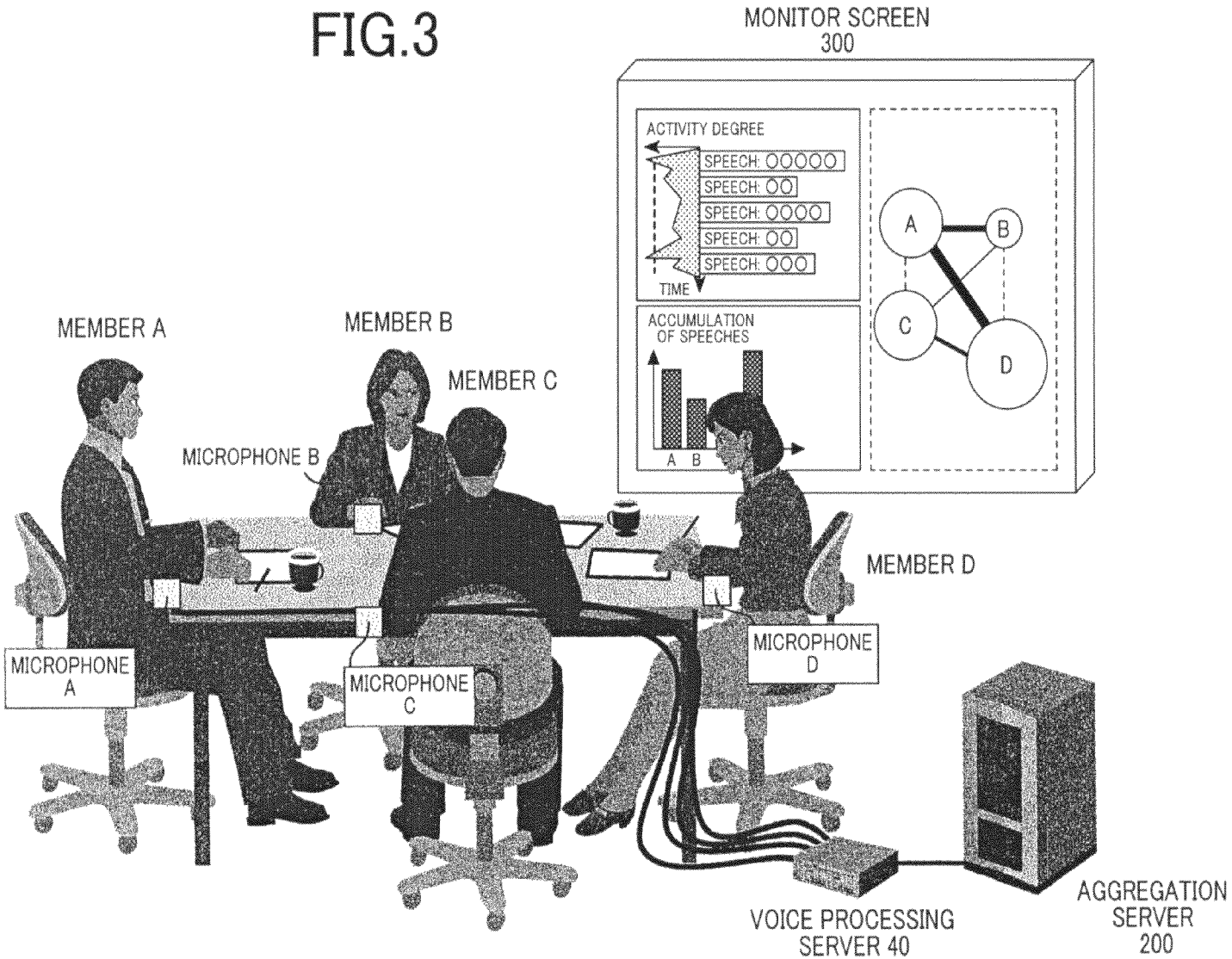
FIG. 3 is a diagram showing an example of using the meeting visualization system according to the first embodiment.

An example of a meeting scene utilizing a meeting visualization system of a first embodiment is shown in FIG. 3. Four members (members A, B, C, and D) are holding a meeting. Speeches of the respective members are sensed by microphones (microphones A, B, C, and D) placed on a meeting table, and these speech data pieces are subjected to a predetermined process by an aggregation server 200 through a voice processing server 40. Finally, the situations of the meeting are displayed in real time on a monitor screen 300. The participating members directly receive feedback from the visualized meeting situations, so that it can be effectively expected that motivations of the respective members are motivated to make speeches and a master conducts the meeting so as to collect a lot of ideas. It should be noted that the servers such as the voice processing server 40 and the aggregation server 200 are synonymous with normal computer systems, and for example, the aggregation server 200 includes a central processing unit (CPU), a memory unit (a semiconductor memory or a magnetic memory device), input units such as a keyboard and a mouse, and an input/output interface unit such as a communication unit coupled to a network. Further, the aggregation server 200 includes a configuration, if necessary, in which a reading/writing unit for media such as a CD and a DVD is coupled through an internal bus. It is obvious that the voice processing server 40 and the aggregation server 200 may be configured as one server (computer system).

Figure 1:
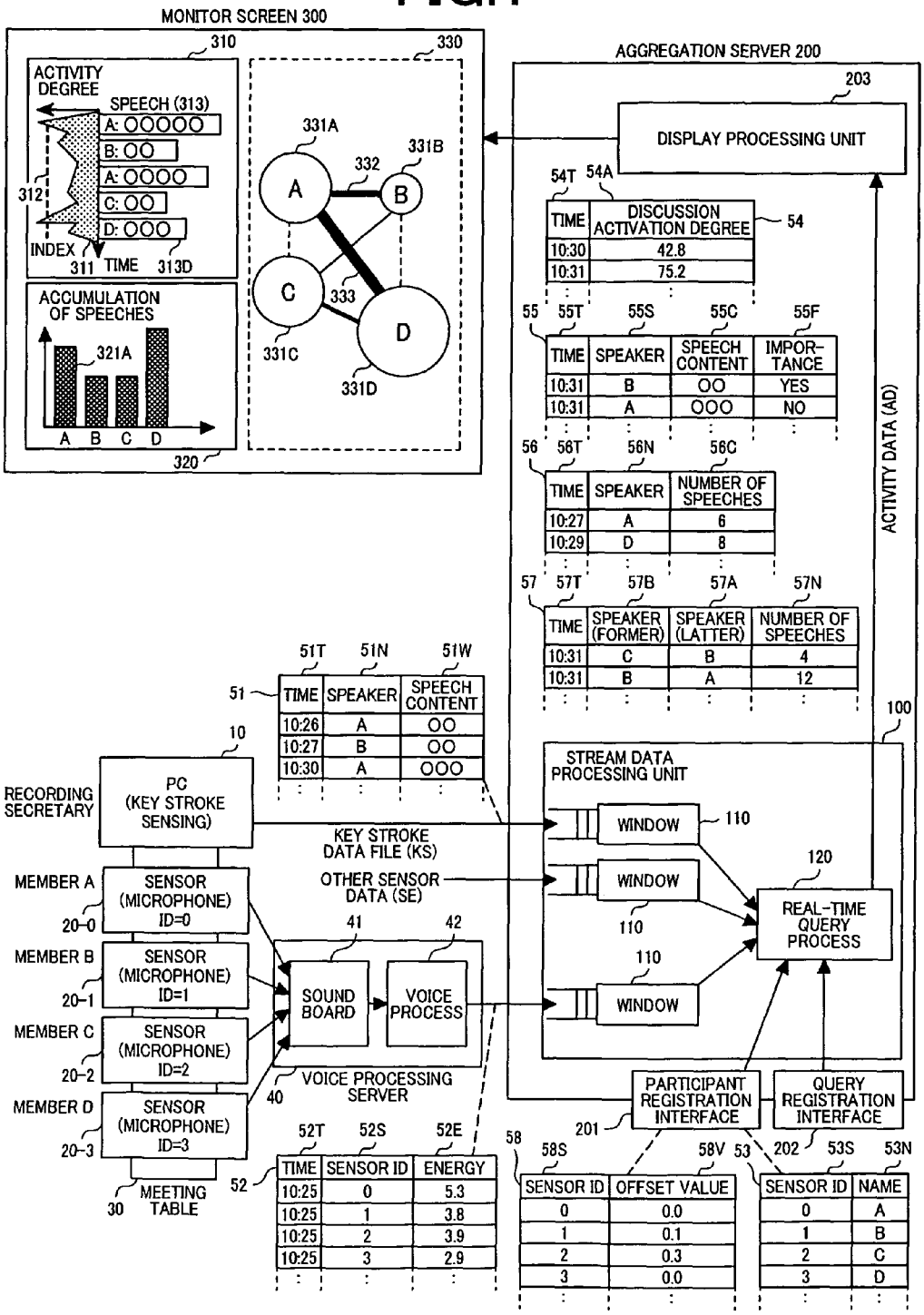
FIG. 1 is a configuration diagram of a meeting visualization system according to a first embodiment.

The whole diagram of the meeting visualization system of the first embodiment is shown in FIG. 1. The meeting visualization system includes roughly three functions of sensing of activity situations, aggregation and analysis of sensing data, and display of the results. Hereinafter, the system will be described in detail in accordance with this order. On a meeting table 30, there are placed sensors (microphones) 20 that are voice collecting units in accordance with positions where the members are seated. When the members make speeches at the meeting, the sensors 20 sense the speeches. Further, a personal computer (PC) 10 is placed on the meeting table 30. The PC 10 functions as a key stroke information output unit and outputs key stroke data produced when a recording secretary of the meeting describes the record of proceedings. The key stroke data is input to the aggregation server 200 through the input/output interface unit of the aggregation server 200.

In the example of FIG. 1, four sensors (sensors 20-0 to 20-3) are placed, and obtain the speech voice of the members A to D, respectively. The voice data obtained from the sensors 20 is transferred to the voice processing server 40. The voice processing server 40 allows a sound board 41 installed therein to perform a sampling process of the voice data, and then, feature data of the sound (specifically, the magnitude of voice energy and the like) is extracted by a voice processing unit 42. The voice processing unit 42 is usually configured as a program process in a central processing unit (CPU) (not shown) in the voice processing server 40. The feature data generated by the voice processing server 40 is transferred to the input/output interface unit of the aggregation server 200 as speech information of the members through an input/output interface unit of the voice processing server 40. Voice feature data 52 to be transferred includes a time 52T, a sensor ID (identifier) 52S, and an energy 52E. In addition, key stroke data 51 obtained from the PC 10 that is a speaker/speech content output unit is also transferred to the aggregation server 200, and include a time 51T, a speaker 51N, and a speech content 51W.

These sensing data pieces are converted into activity data AD used for visualizing the situations of the meeting at a stream data processing unit 100 in the aggregation server 200. The stream data processing unit 100 has windows 110 corresponding to respective data sources, and performs a predetermined numeric operation for time-series data sets stored into the memory for a certain period of time. The operation is called a real time query process 120, and setting of a concrete query and association of the participants with data IDs are performed through a query registration interface 202 and a participant registration interface 201, respectively. It should be noted that the stream data processing unit 100, the participant registration interface 201, and the query registration interface 202 are configured as programs executed by the processing unit (CPU) (not shown) of the above-described aggregation server 200.

The activity data AD generated by the stream data processing unit 100 is usually stored into a table or the like in the memory unit (not shown) in the aggregation server 200, and is sequentially processed by a display processing unit 203. In the embodiment, four pieces of data are generated as concrete activity data AD.

The first piece of activity data is a discussion activation degree 54 which includes plural lists composed of a time 54T and a discussion activation degree 54A at the time. The discussion activation degree 54A is calculated by using the sum of speech amounts on the discussion and the number of participating members as parameters. For example, the discussion activation degree 54A is determined by a total number of speeches and a total number of participants who made speeches per unit time. In FIG. 1, the discussion activation degree 54 per one minute is exemplified. The second piece of activity data is speech content data 55 which is composed of a time 55T and a speaker 55S, a speech content 55C, and an importance 55F associated with the time. The time 51T, the speaker 51N, and the speech content 51W included in the key stroke data 51 from the PC 10 are actually mapped into the time 55T, the speaker 55S, and the speech content 55C, respectively. The third piece of activity data is the-number-of-speeches data 56 which is composed of a time 56T, a speaker 56N associated with the time, and the-accumulation (number)-of-speeches 56C associated with the speaker 56N. The fourth piece of activity data is speech sequence data 57 which is composed of a time 57T and a relation of the order of speeches made by speakers associated with the time. Specifically, immediately after a speaker (former) 57B makes a speech at the time, the-number-of-speeches 57N made by a speaker (latter) 57A is obtained within a certain window time.

On the basis of the activity data AD generated by the stream data processing unit 100, a drawing process is performed by the display processing unit 203. That is, the activity data AD is used as material data for the drawing process by the succeeding display processing unit 203. The display processing unit 203 is also provided as a drawing processing program executed by the processing unit (CPU) of the aggregation server 200. For example, when displaying on a Web basis, a generating process of an HTML (Hyper Text Makeup Language) image is performed by the display processing unit 203. The image generated by the display processing unit 203 is output to the monitor through its input/output interface unit, and is displayed in a screen configuration shown on the monitor screen 300. The conditions of the meeting are displayed on the monitor screen 300 as three elements of an activity-degree/speech display 310, the-accumulation-of-speeches 320, and a speech sequence 330.

Hereinafter, there will be described three elements displayed by using the activity data that is material data. In the activity-degree/speech display 310, an activity degree 311 and a speech 313 at the meeting are displayed in real time along with the temporal axis. The activity degree 311 displays the discussion activation degree 54 of the activity data AD, and the speech 313 displays the speech content data 55 of the activity data AD. In addition, an index 312 of the activity degree can be displayed on the basis of statistical data of the meeting. The-accumulation-of-speeches 320 displays the number of speeches for each participant as accumulation from the time the meeting starts, on the basis of the-number-of-speeches data 56 of the activity data AD. Finally, the speech sequence 330 allows the discussions exchanged among the participants to be visualized by using the-number-of-speeches data 56 and the speech sequence data 57 of the activity data AD.

Specifically, the sizes of circles (331A, 331B, 331C, and 331D) for the respective participants illustrated in the speech sequence 330 represent the number of speeches for a certain period of time from the past to the present (for example, for 5 minutes), and the thicknesses of links between the circles represent whether the number of conversations among the participants is large or small (that is, the amount of interaction of conversation) for visualization. For example, a link 332 between A and B is thin, and a link 333 between A and D is thick, which means that the number of interactions between A and D is larger. In this example, a case where the member D makes a speech after a speech made by the member A is not discriminated from a case where the member A makes a speech after a speech made by the member D. However, a display method of discriminating these cases from each other can be employed by using the speech sequence data 57. It is obvious that the respective elements of the activity-degree/speech display 310, the-accumulation-of-speeches 320, and the speech sequence 330 can be appropriately displayed using the respective pieces of material data by executing an ordinary drawing processing program with the processing unit (CPU) (not shown) of the aggregation server 200.

Figure 2:
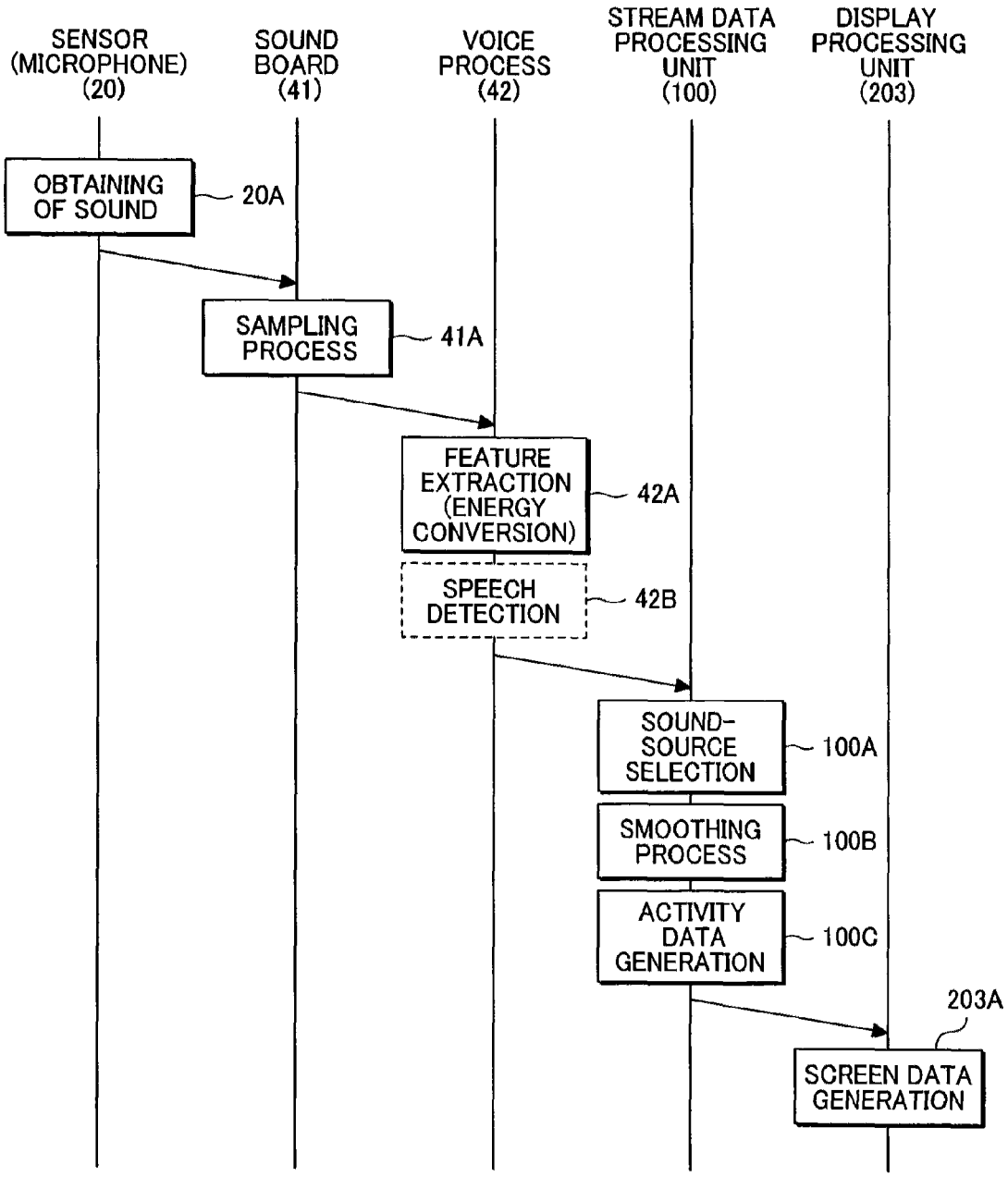
FIG. 2 is a sequence diagram of the meeting visualization system according to the first embodiment.

FIG. 2 shows a processing sequence of representative function modules in the whole diagram shown in FIG. 1. First of all, the sensors (microphones) 20 as voice collecting units obtain voice data (20A). Next, a sampling process of the voice is performed by the sound board 41 (41A). Next, extraction (specifically, conversion into energy) of the feature as speech information is performed by the voice processing unit 42 (42A). The energy is obtained by, for example, integrating the square of an absolute value of a sound waveform of a few milliseconds throughout the entire range of the sound waveform. It should be noted that in order to perform a voice process with higher accuracy at the succeeding stage, it is possible to perform speech detection at this point (42B). A method of discriminating voice from non-voice includes discrimination by using a degree of changes in energy for a certain period of time. Voice contains the magnitude of sound waveform energy and its change pattern, by which voice is discriminated from non-voice. As described above, the feature extraction 42A and the speech detection 42B are executed as program processing by the processing unit (CPU) (not shown).

Next, a sound-source selection (100A), a smoothing process (100B), and an activity data generation (100C) are performed by the stream data processing unit 100. Finally, an image data generation (203A) is performed by the display processing unit 203 on the basis of the activity data AD. The concrete configurations of these processes will be described later because most of the configurations are shared in the other embodiments.

Figure 4:
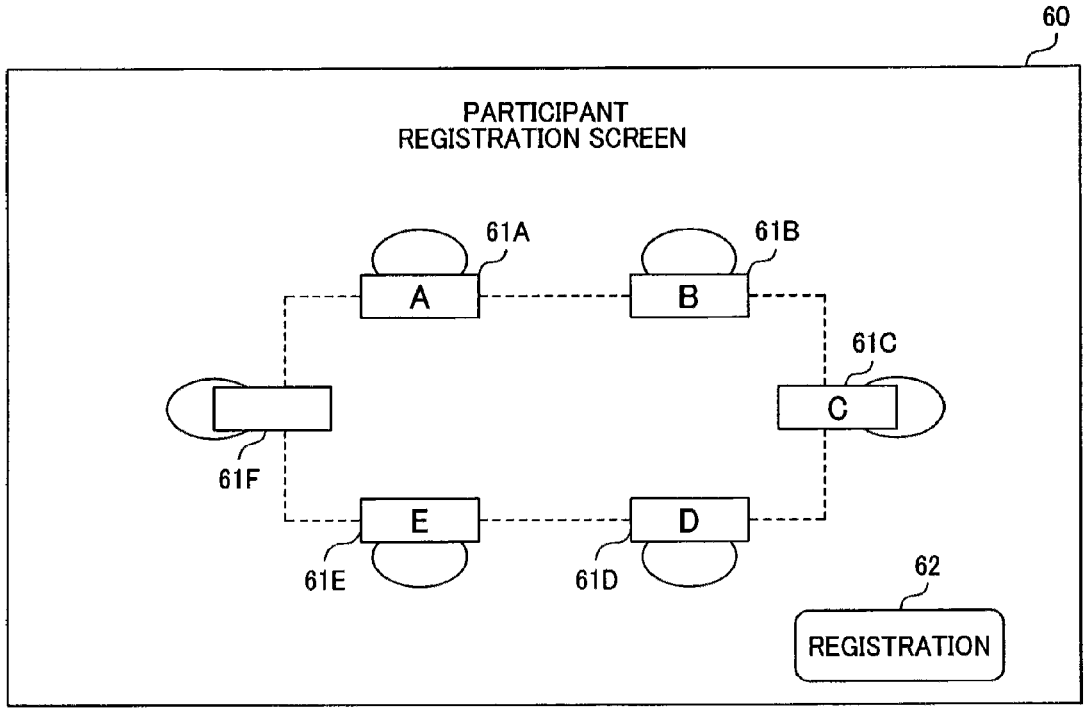
FIG. 4 is an image diagram of a participant registration screen according to the first embodiment.

FIG. 4 shows a registration screen 60 of participants. In order to associate the members who are seated on respective chairs around the meeting table 30 with the microphones (20), the names of the participants are input to blanks of seated positions (61A to 61F) on the screen for registration (62). FIG. 4 shows an example in which the participant names A, B, C, and D are registered in the seated positions 61A, 61B, 61C, and 61D, respectively. The registration screen 60 may be a screen of the above-described PC, or an input screen of an input tablet for handwritten characters placed at each seated position. These registration operations are performed by using the participant registration interface 201 of the aggregation server 200 on the basis of name data input with these input means.

According to the above-described meeting visualization system of the first embodiment, the situations of the meeting that change every second can be displayed in real time by calculating the speaker, the number of speeches, the speech sequence, and the activity degree of the meeting. Accordingly, the situations are fed back to the participants, which can trigger a positive discussion with a high activity degree.

Second Embodiment

In the first embodiment, a method of visualizing the meeting on the basis of voice data obtained from the microphones 20 is shown. In the second embodiment, devices called wireless sensor nodes are given to the participating members of the meeting, so that it is possible to provide a meeting visualization system by which the situations of the meeting can be visualized in more detail by adding information other than voice.

Figure 11:
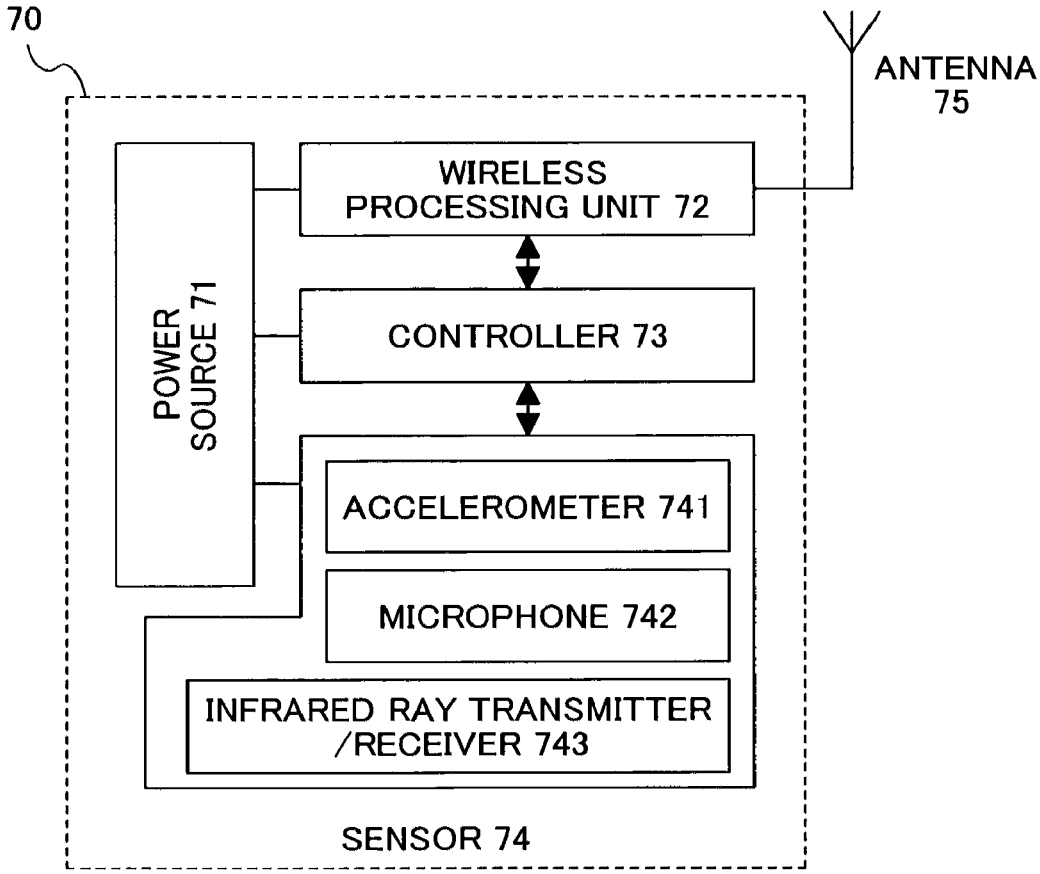
FIG. 11 is a block diagram of a wireless sensor node according to the second embodiment.

First of all, a configuration of a wireless sensor node will be described by using FIG. 11. FIG. 11 is a block diagram showing an example of a configuration of a wireless sensor node 70. The wireless sensor node 70 includes a sensor 74 which performs measurement of motions of the members themselves (using an acceleration degree), measurement of voice (using the microphones), and measurement of seated positions (using transmission/reception of infrared rays), a controller 73 which controls the sensor 74, a wireless processing unit 73 which communicates with a wireless base station 76, a power source 71 which supplies electric power to the respective blocks, and an antenna 75 which transmits or receives wireless data. Specifically, an accelerometer 741, a microphone 742, and an infrared ray transmitter/receiver 743 are mounted in the sensor 74.

The controller 73 reads the data measured by the sensor 74 for a preliminarily-set period or at random times, and adds a preliminarily-set ID of the sensor node to the measured data so as to transfer the same to the wireless processing unit 72. Time information when the sensing is performed is added, as a time stamp, to the measured data in some cases. The wireless processing unit 72 transmits the data transmitted from the controller 73 to the base station 76 (shown in FIG. 12). The power source 71 may use a battery, or may include a mechanism of self-power generation such as a solar battery and oscillation power generation.

Figure 12:
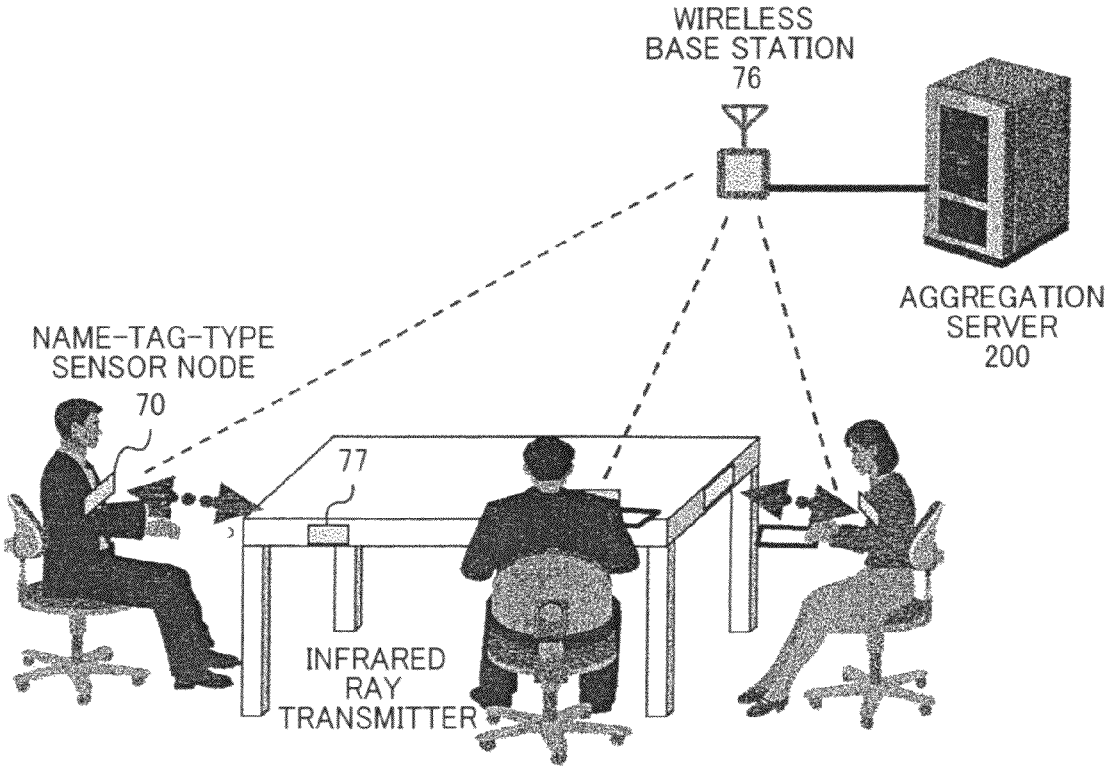
FIG. 12 is a diagram for explaining a configuration of using a name-tag-type sensor node according to the second embodiment.

As shown in FIG. 12, a name-tag-type sensor node 70A obtained by shaping the wireless sensor node 70 into a name tag shape is attached to a user, so that sensing data relating to a state (motion and the like) of the user can be transmitted to the aggregation server 200 in real time through the wireless base station 76. Further, as shown in FIG. 12, ID information from an infrared ray transmitter 77 placed at each seated position around the meeting table is regularly detected by the infrared ray transmitter/receiver 743 of the name-tag-type sensor node 70A, so that information of the seated positions can be autonomously transmitted to the aggregation server 200. As described above, if the information of the seated position of the user is automatically transmitted to the aggregation server 200 by the name-tag-type sensor node 70, the participant registration process (FIG. 4) using the registration screen 60 can be automatically performed in the embodiment.

Next, the stream data processing unit 100 for realizing the above-described meeting visualization system will be described in detail by using FIG. 5 and the following figures. A stream data process is used for generation of the activity data in the respective embodiments. A technique itself called a stream data process is well known in the art, and is disclosed in documents, such as B. Babcock, S. Babu, M. Datar, R. Motwani and J. Widom, "Models and issues in data stream systems", In Proc. of PODS 2002, pp. 1-16. (2002), A. Arasu, S. Babu and J. Widom, "CQL: A Language for Continuous Queries over Streams and Relations", In Proc. of DBPL 2003, pp. 1-19 (2003).

Figure 5:
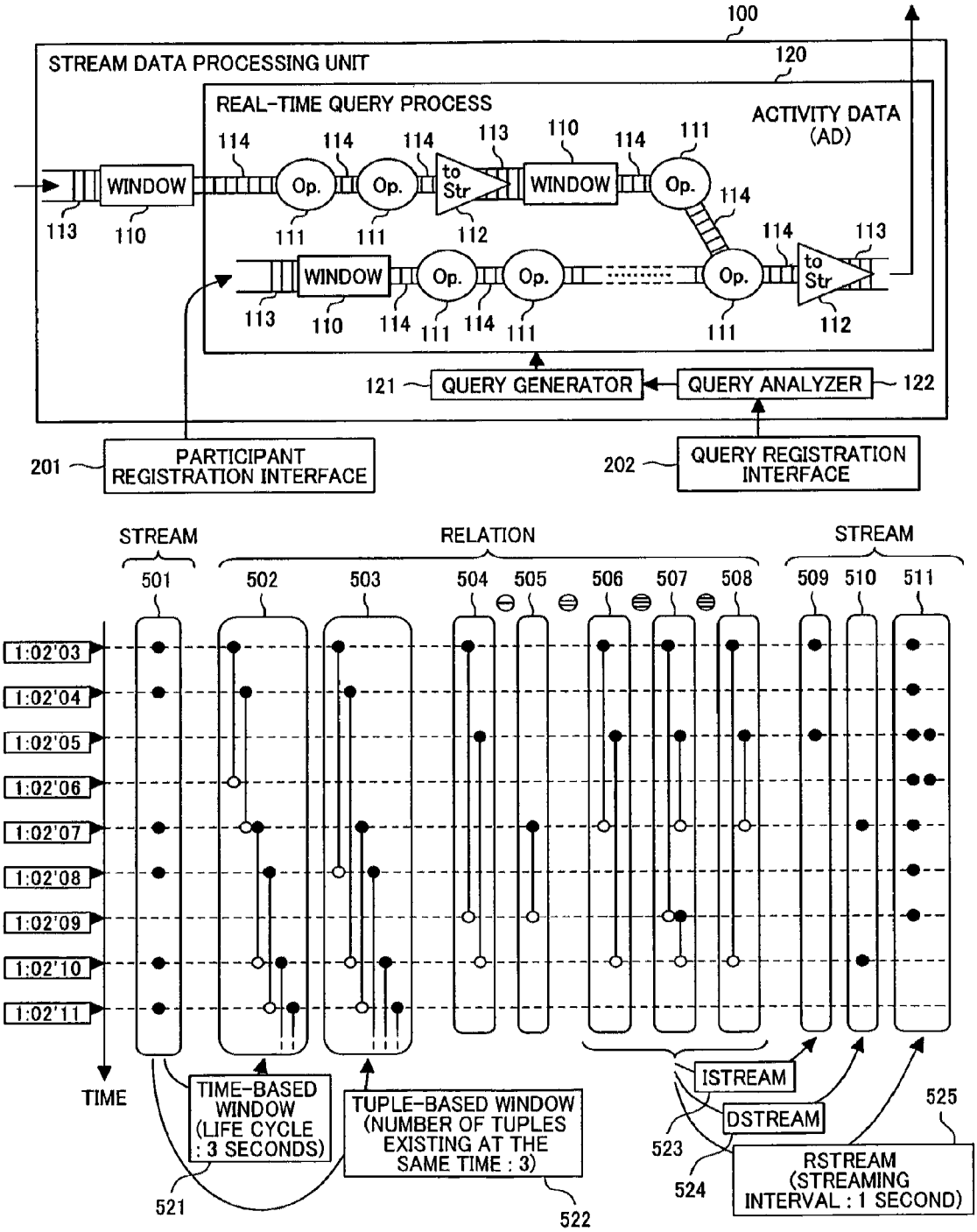
FIG. 5 is a configuration diagram of a general stream data process according to a second embodiment.

FIG. 5 is a diagram for explaining a function operation of the stream data processing unit 100 in FIG. 1. The stream data process is a technique for continuously executing a filtering process and an aggregation for the flow of data that comes in without cease. Each piece of data is given a time stamp, and the data flow while arranged in ascending order of the time stamps. In the following description, such the flow of data is referred to as a stream, and each piece of data is referred to as a stream tuple or simply referred to as a tuple. The tuples flowing on one stream comply with a single data type. The data type is called a schema. The schema is a combination of an arbitrary number of columns, and each column is a combination of one basic type (an integer type, a real-number type, a character string type, or the like) and one name (column name).

In the stream data process, operations such as projection, selection, join, aggregation, union, and set difference are executed for tuples on a stream for which schemata are defined, in accordance with a relational algebra that is a calculation model of a relational data base. However, the relational algebra is defined for data sets, so that in order to continuously process a stream in which data strings continue without cease (that is, elements of sets infinitely increase) by using the relational algebra, the relational algebra needs to operate on tuple sets while always limiting the target of the tuple sets.

Therefore, a window operator for limiting the target of tuple sets at a given time is defined in the stream data process. As described above, a processing period is defined for tuples on a stream by the window operator before the relational algebra operates on the tuples. In the following description, the period is referred to as a life cycle of a tuple, and a set of tuples for which the life cycle is defined is referred to as a relation. Then, the relational algebra operates on the relation.

An example of the window operator will be described using the reference numerals 501 to 503. The reference numeral 501 denotes a stream, and 502 and 503 denote relations that are results obtained by carrying out the window operator for the stream 501. The window operator includes a time-based window and a tuple-based window depending on definition of the life cycle. The time-based window sets the life cycle of each tuple to a constant period. On the other hand, the tuple-based window limits the number of tuples that exist at the same time to a constant number. The relations 502 and 503 show the results obtained by processing the stream 501 with the time-based window (521) and the tuple-based window (522), respectively.

Each black circle in the drawing of the stream represents a stream tuple. In the stream 501, there exist six stream tuples that flow at 01:02:03, 01:02:04, 01:02:07, 01:02:08, 01:02:10, and 01:02:11. On the other hand, each line segment in which a black circle serves as a starting point and a white circle serves as an ending point in the drawing of the relation represents the life cycle of each tuple. A time precisely at an ending point is not included in the life cycle. The relation 502 is a result obtained by processing the stream 501 with the time-based window having a life cycle of 3 seconds. As an example, the life cycle of the tuple at 01:02:03 is from 01:02:03 to 01:02:06. However, just 01:02:06 is not included in the life cycle. The relation 503 is a result obtained by processing the stream 501 with the tuple-based window having three tuples existing at the same time. As an example, the life cycle of the tuple at 01:02:03 is from 01:02:03 to 01:02:08 when the third tuple counted from the tuple generated at 01:02:03 flows. However, just 01:02:08 is not included in the life cycle.

The relational algebra on the relation produces a resulting relation having the following property as an operation result for an input relation. A result obtained by operating a conventional relational algebra on a set of tuples existing at a given time in an input relation is referred to as a resulting tuple set at the given time. At this time, the resulting tuple set at the given time coincides with a set of tuples existing at the given time in a resulting relation.

An example of the relational algebra on the relation will be described using the reference numerals 504 to 508. This example shows a set difference operation between the relations 504 and 505, and the relations 506, 507, and 508 show the results. For example, tuple sets existing at 01:02:08 in the input relations 504 and 505 are composed of two tuples and one tuple, respectively. Thus, the resulting tuple set (namely, the set difference between the both tuple sets) at 01:02:08 is a tuple set composed of one tuple obtained by subtracting one tuple from two tuples. Such a relation is satisfied for a period from 01:02:07 to 01:02:09 (just 01:02:09 is not included). Accordingly, in the resulting relations, the number of tuples existing for the period is one. As an example of the resulting relations, all of the relations 506, 507, and 508 have such property. As described above, the results of the relational algebra on the relations are not uniquely determined. However, the all results are equivalent as targets of the relational algebra on relations in the stream data process.

As described above, since the results of the relational algebra on the relations are not uniquely determined, it is not preferable to pass the results to applications as they are. On the other hand, before the relations are passed to the applications, an operation for converting the relations into a stream again is prepared in the stream data process. This operation is called a streaming operator. The streaming operator allows all of the equivalent resulting relations to be converted into the same stream.

The stream converted from the relations by the streaming operator can be converted into the relations by the window operator again. As described above, in the stream data process, conversion into relations and a stream can be arbitrarily combined.

The streaming operator includes three kinds of IStream, DStream, and RStream. If the number of tuples is increased in a tuple set existing at a given time in a relation, IStream outputs the increased tuples as stream tuples each having a time stamp of that given time. If the number of tuples is decreased in a tuple set existing at a given time in a relation, DStream outputs the decreased tuples as stream tuples each having a time stamp of that given time. RStream outputs a tuple set existing at the point in a relation as stream tuples at constant intervals.

An example of the streaming operator will be described by using the reference numerals 509 to 511. The reference numeral 509 denotes a result obtained by streaming the relations 506 to 508 with IStream (523). As an example, in the relation 506, the number of tuples is increased from 0 to 1 at 01:02:03, and from one to two at 01:02:05. Therefore, the increased one stream tuple is output to the stream 509 each at 01:02:03 and 01:02:05. The same result can be obtained even when processing the relation 507. For example, although the life cycle of one tuple starts at 01:02:09 in the relation 507, the life cycle of another tuple (a tuple having a life cycle starting at 01:02:03) ends at the same time. At this time, since just 01:02:09 is not included in the life cycle of the latter tuple, the number of tuples existing at 01:02:09 is just one. Accordingly, the number of tuples is not increased or decreased at 01:02:09, so that the stream tuple increased at 01:02:09 is not output similarly to the result for the relation 506. Also in DStream (524) and RStream (525), results obtained by streaming the relations 506, 507, and 508 are shown as in streams 510 and 511 (the streaming interval of RStream is one second). As described above, the resulting relations that are not uniquely determined can be converted into a unique stream by the streaming operator. In the diagrams that follow FIG. 5, the white circles representing the end of the life cycle are omitted.

In the stream data process, the contents of the data process are defined by a declarative language called CQL (Continuous Query Language). The grammar of CQL has a format in which notations of the window operator and the streaming operator are added to SQL of a query language that is used as the standard in a relational data base and is based on the relational algebra. Here, the outline thereof will be described. The following four lines are an example of a query complied with the CQL grammar.

```
REGISTER QUERY q AS
 ISTREAM(
  SELECT c1
  FROM st[ROWS 3]
  WHERE c2=5)
```

The "st" in the FROM phrase is an identifier (hereinafter, referred to as a stream identifier, or a stream name) representing a stream. A portion surrounded by "[" and "]" that follow the stream name represents a notation showing the window operator. The description "st[ROWS 3]" in the example represents that the stream "st" is converted into relations by using the tuple-based window having three tuples existing at the same time. Accordingly, the whole description expresses outputting of relations. It should be noted that the time-based window has a notation in which a life cycle is represented subsequent to "RANGE" as in "[RANGE 3 sec]". The other notations include "[NOW]" and "[UNBOUNDED]", which mean a very short life cycle (not 0) and permanence, respectively.

The relational algebra operates on the relation of the FROM phrase. The description "WHERE c2=5" in the example means that a tuple in which a column c2 indicates 5 is selected. In addition, the description "SELECT c1" in the example means that only a column c1 of the selected tuple is left as a resulting relation. The meaning of these descriptions is completely the same as SQL.

Further, a notation in which the whole expression from the SELECT phrase to the WHERE phrase for generating relations is surrounded by "(" and ")", and a streaming specification (the description "ISTREAM" in the example) is placed before the surrounded portion represents the streaming operator of the relations. The streaming specification further includes "DSTREAM" and "RSTREAM". In "RSTREAM", a streaming interval is specified by surrounding with "[" and "]".

The query in this example can be decomposed and defined in the following manner.

```
REGISTER QUERY s AS
 st [ROWS 3]
REGISTER QUERY r AS
 SELECT c1
 FROM s
 WHERE c2=5
REGISTER QUERY q AS
ISTREAM (r)
```

Here, only an expression for generating a stream can be placed before the window operator, only an expression for generating relations can be placed in the FROM phrase, and only an expression for generating relations is used for an argument of the streaming operator.

The stream data processing unit 100 in FIG. 5 shows a software configuration for realizing the stream data process as described above. When a query defined by CQL is given to the query registration interface 202, the stream data processing unit 100 allows a query analyzer 122 to parse the query, and allows a query generator 121 to expand the same into an execution format (hereinafter, referred to as an execution tree) having a tree configuration. The execution tree is configured to use operators (window operators 110, relational algebra operators 111, and streaming operators 112) executing respective operations as nodes, and to use queues of tuples (stream queues 113 and relation queues 114) connecting between the operators as edges. The stream data processing unit 100 proceeds with a process by executing the processes of the respective operators of the execution tree in random order.

In accordance with the above-described stream data processing technique, a stream 52 of speech information that is transmitted from the voice processing server 40 and stream tuples such as streams 53 and 58 that are registered through the participant registration interface 201 and transmitted from the outside of the stream data processing unit 100 are input to the stream queue 113 in the first place. The life cycles of these tuples are defined by the window operator 110, and are input to the relation queue 114. The tuples on the relation queue 114 are processed by the relational algebra operators 111 through the relation queues 114 in a pipelined manner. The tuples on the relation queue 114 are converted into a stream by the streaming operator 112 so as to be input to the stream queue 113. The tuples on the stream queue 113 are transmitted to the outside of the stream data processing unit 100, or processed by the window operator 110. On the path from the window operator 110 to the streaming operator 112, an arbitrary number of relational algebra operators 111 that are connected to each other through the relation queues 114 are placed. On the other hand, the streaming operator 112 is directly connected to the window operator 110 through one stream queue 113.

Figure 15:
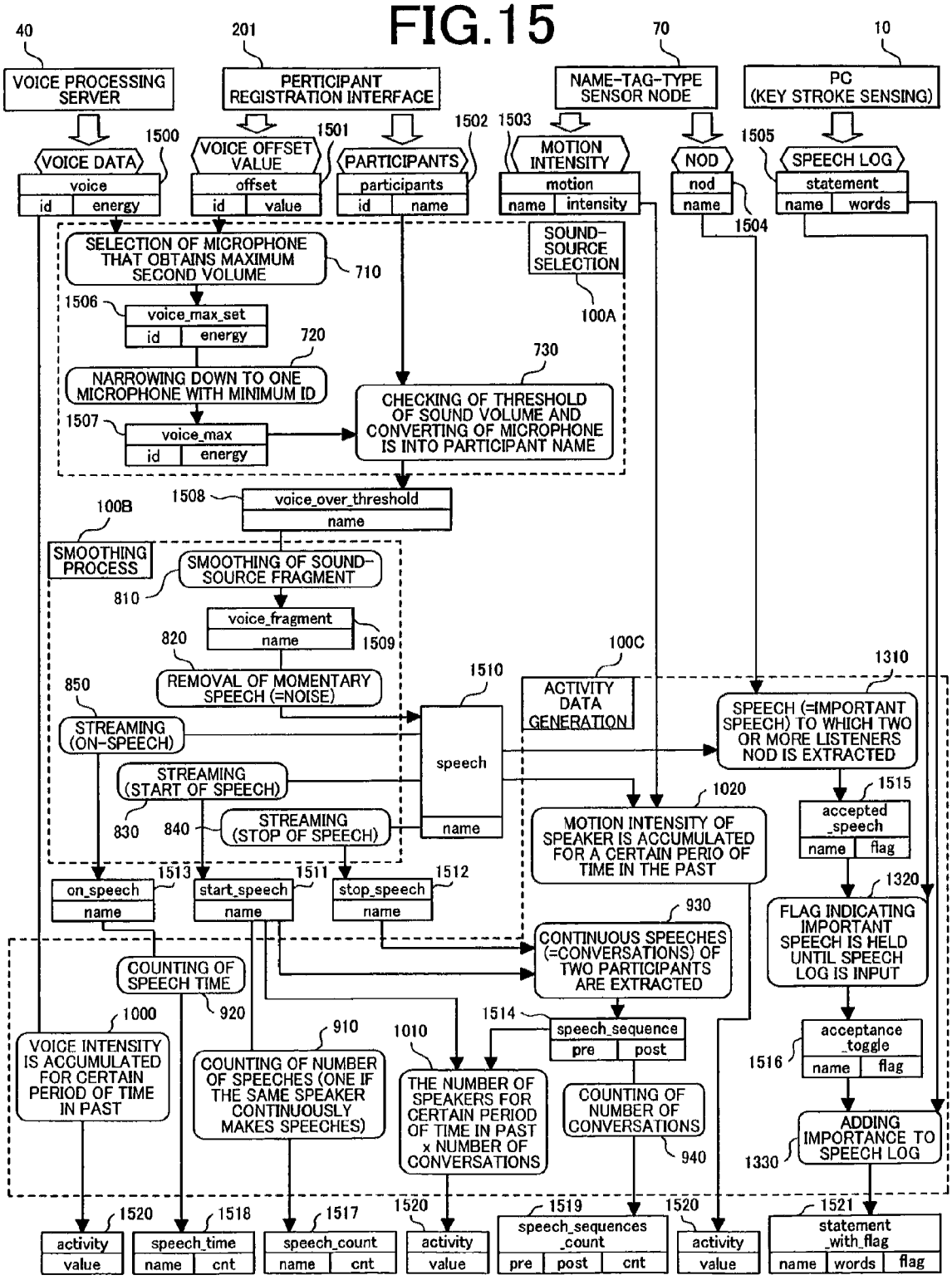
FIG. 15 is a diagram for explaining, in detail, an example of realizing a meeting visualization data process by a stream data process.

Next, there will be concretely disclosed a method of realizing a meeting visualization data process by the stream data processing unit 100 in the meeting visualization system of the embodiment by using FIG. 15.

The reference numerals 1500 to 1521 denote identifiers and schemata of streams or relations. The upper square with thick lines represents an identifier, and the lower parallel squares represent column names configuring a schema. Each of squares with round corners having the reference numerals 710, 720, 730, 810, 820, 830, 840, 850, 910, 920, 930, 940, 1000, 1010, 1020, 1310, 1320, and 1330 represents a basic process unit of a data process. Each of the basic process units is realized by a query complied with the CQL grammar. A query definition and a query operation will be described later using FIGS. 7 to 10, and FIG. 13. A voice feature data stream 1500 that is speech information is transmitted from the voice processing server 40. A sound volume offset value stream 1501 and a participant stream 1502 are transmitted from the participant registration interface 201. A motion intensity stream 1503 and a nod stream 1504 are transmitted from the name-tag-type sensor node 70. A speech log stream 1505 is transmitted from the PC (key stroke sensing) 10. These streams are processed by the sound-source selection 100A, the smoothing process 100B, and the activity data generation 100C in this order, and streams 1517 to 1521 are generated as outputs. The reference numeral 1506 and 1516 denote streams or relations serving as intermediate data.

The process of the sound-source selection 100A includes the basic process units 710, 720, and 730. A configuration for realizing each process will be described later using FIG. 7. The smoothing process 100B includes the basic process units 810, 820, 830, 840, and 850. A configuration for realizing each process will be described later using FIG. 8. The process of the activity data generation 100C includes the basic process units 910, 920, 930, 940, 1000, 1010, 1020, 1310, 1320, and 1330. The basic process units 910 to 940 generate the-number-of-speeches 1517 to be visualized at the section 320 on the monitor screen 300, and a speech time 1518 and the-number-of-conversations 1519 to be visualized at the section 330 on the monitor screen 300. These basic process units will be described later using FIG. 9. The basic process units 1000 to 1020 generate an activity degree 1520 to be visualized at the section 311 on the monitor screen 300. These basic process units will be described later using FIG. 10. The basic process units 1310 to 1330 generate a speech log 1521 to be visualized at the section 313 on the monitor screen 300. These basic process units will be described later using FIG. 13.

Figure 6:
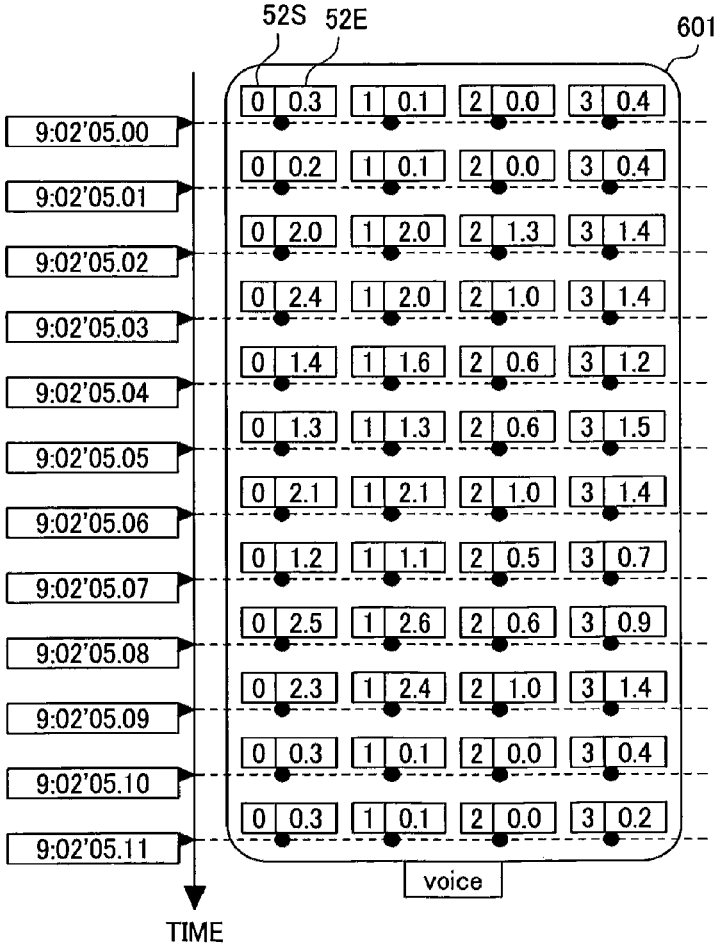
FIG. 6 is a diagram for explaining an example of schema registration of an input stream according to the second embodiment.

Next, schema registration of input streams will be described by using FIG. 6.

A command 600 is input to the stream data processing unit 100 from, for example, an input unit of the aggregation server 200 through the query registration interface 202, so that six stream queues 113 that accept the input streams 1500 to 1505 are generated. The stream names are indicated immediately after REGISTER STREAM, and the schemata are indicated in parentheses. The individual descriptions sectioned by "," in the schema represent a combination of the name and type of columns.

The reference numeral 601 denotes an example of stream tuples input to the voice feature data stream 1500 (voice). This example shows a state in which stream tuples each having a combination of a sensor ID (id column) and a sound volume (energy column) are generated from four microphones every 10 milliseconds.

Figure 7:
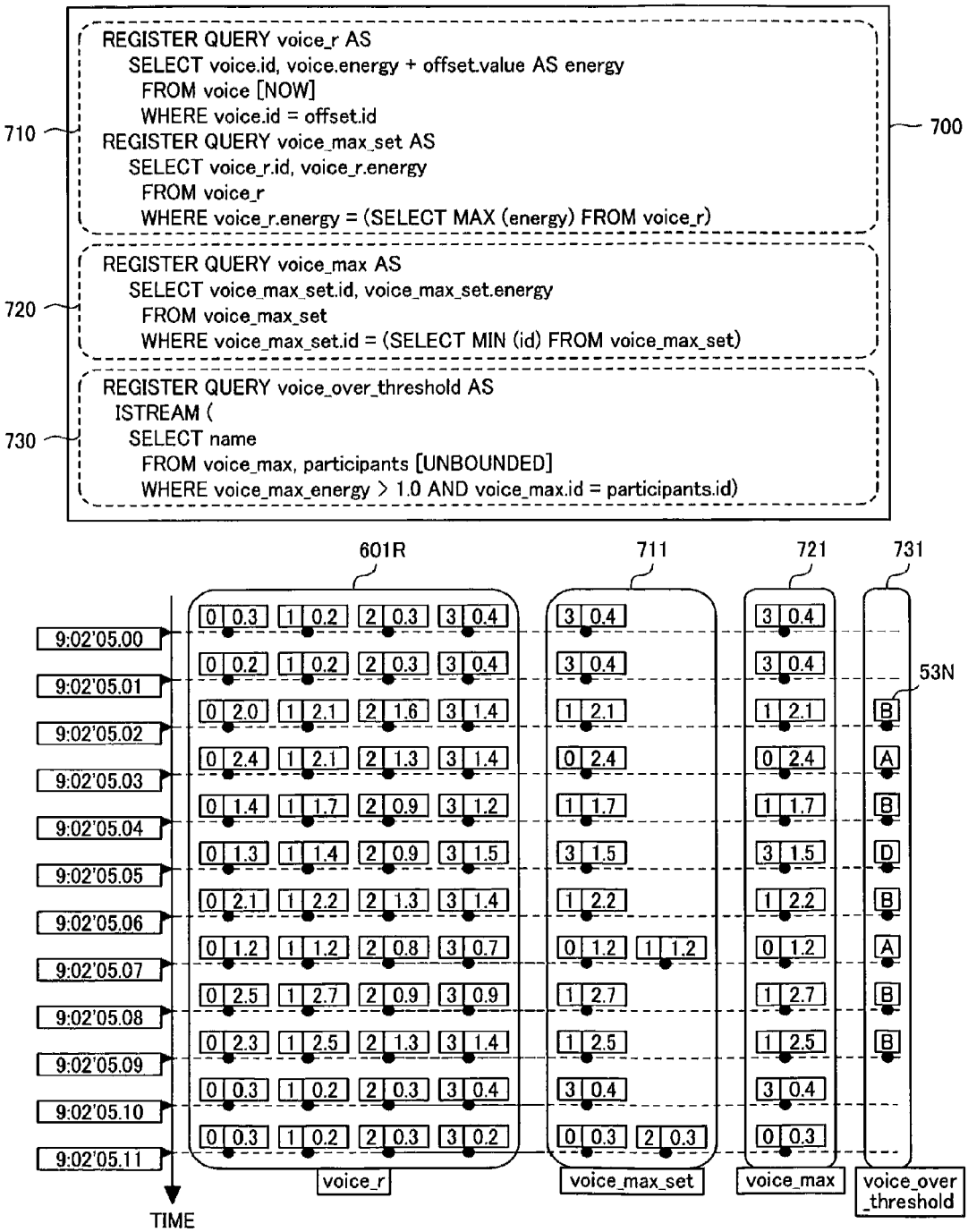
FIG. 7 is a diagram for explaining a configuration for realizing a sound-source selection process according to the second embodiment.

Next, there will be disclosed a method of realizing the basic process units 710, 720, and 730 of the sound-source selection process 100A by using FIG. 7.

A command 700 is input to the stream data processing unit 100 through the query registration interface 202, so that the execution tree for realizing the basic process units 710, 720, and 730 is generated. The command 700 is divided into three query registration formats 710, 720, and 730 that define the processing contents of the basic process units 710, 720, and 730, respectively (hereinafter, the basic process units are synonymous with the query registration formats that define the processing contents thereof, and they are shown by using the same reference numerals. In addition, the query registration format is simply referred to a query.).

The query 710 selects the microphone 20 that records the maximum sound volume at every 10 milliseconds. A constant offset value is preferably added to the sound volume of each microphone. The sensitivities of the respective microphones attached to the meeting table vary due to various factors such as the shape and material of the meeting table, positional relationship to a wall, and the qualities of the microphones themselves, so that the sensitivities of the microphones are uniformed by the adding process. The offset values that are different depending on the microphones are registered through the participant registration interface 201 as the sound volume offset value stream 1501 (offset). The stream 58 in FIG. 1 is an example of the sound volume offset value stream (a sensor-ID column 58S and an offset value column 58V represent the id column and the value column of the sound volume offset value stream 1501, respectively). The voice data stream 1500 and the sound volume offset value stream 1501 are joined together by the join operator relating to the id column, and the value of the offset value column (value) of the sound volume offset value stream 1501 is added to the value of the sound volume column (energy) of the voice data stream 1500, so that the resulting value newly serves as the value of the energy column. A stream composed of tuples each having a combination of the energy column and the id column is represented as voice_r. The result of the query for the stream 601 and the stream 58 is shown as a stream 601R.

The maximum sound volume is calculated from the stream voice_r by the aggregate operator "MAX (energy)", and tuples having the same value of the maximum sound volume are extracted by the join operator relating to the energy column. The result (voice_max_set) of the query for the stream 601R is shown as a relation 711 (since the query 710 uses a NOW window and the life cycle of each tuple of the relation 711 is extremely short, the life cycle of each tuple is represented by a dot. Hereinafter, the life cycle of each tuple defined by the NOW window is represented by a dot. The query may use a time-based window having less than 10 milliseconds in place of the NOW window.).

There exist two or more microphones that record the maximum sound volume at the same time in some cases. On the other hand, the query 720 selects only data of the microphone having the minimum sensor ID from the result of the query 710, so that the microphones are narrowed down to one. The minimum ID is calculated by the aggregate operator "MIN (id)", and a tuple having the same ID value is extracted by the join operator relating to the id column. The result (voice_max) of the query for the relation 711 is shown as a relation 721.

The query 730 leaves only data exceeding a threshold value as a sound source from the result of the query 720. In addition, the sensor ID is converted into the participant name while associating with the participant data 53. A range selection (>1, 0) is performed for the energy columns, and a stream having the name of the speaker that is a sound source is generated by the join operator relating to the id column and the projection operator of the name column. The result (voice_over_threshold) of the query for the relation 721 is shown as a stream 731. Then, the process of the sound-source selection 100A is completed.

Figure 8:
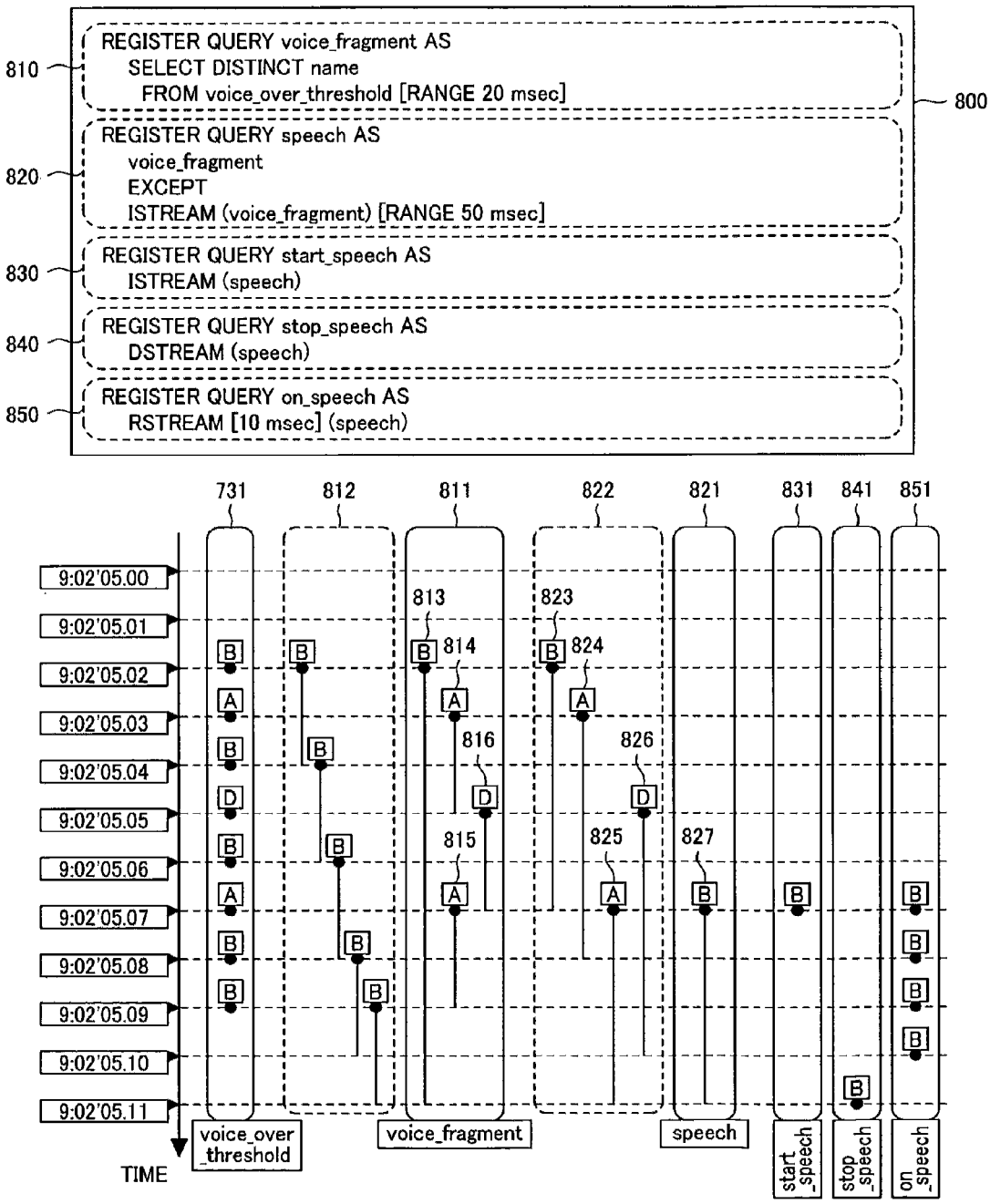
FIG. 8 is a diagram for explaining a configuration for realizing a smoothing process according to the second embodiment.

Next, there will be disclosed a method of realizing the basic process units 810, 820, 830, 840, and 850 of the smoothing process 100B by using FIG. 8.

A command 800 is input to the stream data processing unit 100 through the query registration interface 202, so that the execution tree for realizing the basic process units 810, 820, 830, 840, and 850 is generated.

The query 810 complements intermittent portions of continuous fragments of the sound source of the same speaker in the sound source data obtained by the query 730, and extracts a smoothed speech period. Each tuple on the stream 731 is given a life cycle of 20 milliseconds by the window operator "[RANGE 20 msec]", and duplicate tuples of the same speaker are eliminated by "DISTINCT" (duplicate elimination). The result (voice_fragment) of the query for the stream 731 is shown as a relation 811. A relation 812 is in an intermediate state before leading to the result, and is a result obtained by defining the life cycle of the tuples, on the stream 731, each having a value B in the name column with the window operator. On the stream 731, the tuples each having B in the name column are not present at 09:02:5.03, 09:02:5.05, and 09:02:5.07. However, in the relation 812, a life cycle of 20 milliseconds complements the portions where the tuples each having B in the name column are not present. At 09:02:5.08 and 09:02:5.09 where data continues, the life cycles are duplicated, but are eliminated by DISTINCT. As a result, the tuples each having B in the name column are smoothed to one tuple 813 having a life cycle from 09:02:5.02 to 09:02:5.11. Tuples such as ones each having A or D in the name column that appear in a dispersed manner result in dispersed tuples such as tuples 814, 815, and 816 for which a life cycle of 20 milliseconds is defined.

The query 820 removes a momentary speech (period) having an extremely short duration as a noise from the result of the query 810. Copies (tuples each having the same value in the name column as the original tuples) of the tuples, in the relation 811, each having a life cycle of 50 milliseconds from the starting time of the tuples are generated by the streaming operator "ISTREAM" and the window operator "[RANGE 50 msec]", and are subtracted from the relation 811 by the set difference operator "EXCEPT", so as to remove the tuples each having a life cycle of 50 milliseconds or less. The result (speech) of the query for the relation 811 is shown as a relation 821. The relation 822 is in an intermediate state before leading to the result, and is a result of preparing the copies of the tuples, on the relation 811, each having a life cycle of 50 milliseconds. The set difference between the relations 811 and 822 completely erases the tuples 814, 815, and 816 with tuples 824, 825, and 826. On the other hand, the life cycle of the tuple 823 is subtracted from that of the tuple 813, and a tuple 827 having a life cycle from 09:02:5.07 to 09:02:5.11 is left. As described above, all of tuples each having a life cycle of 50 milliseconds or less are removed, and only tuples each having a life cycle of 50 milliseconds or more are left as actual speech data.

The queries 830, 840, and 850 generate stream tuples having time stamps of speech starting time, speech ending time, and on-speech time with the streaming operators IStream, DStream, and RStream from the result of the query 820. The results (start_speech, stop_speech, and on_speech) of the queries for the relation 821 are shown as streams 831, 841, and 851, respectively. Then, the smoothing process 100B is completed.

Figure 9:
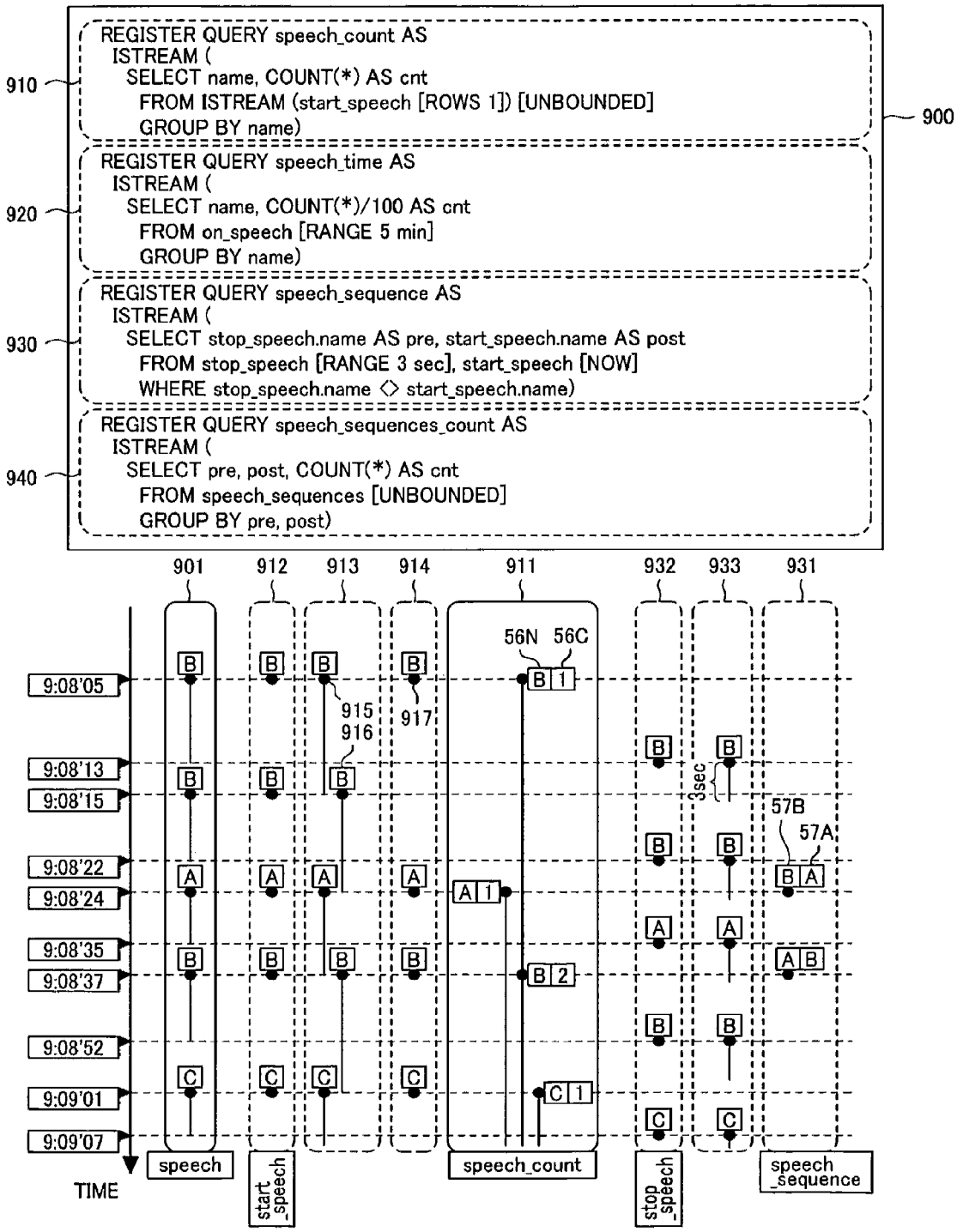
FIG. 9 is a diagram for explaining a configuration for realizing an activity data generation process according to the second embodiment.

Next, there will be disclosed a method of realizing the basic process units 910, 920, 930, and 940 in the activity data generation 100C by using FIG. 9. A command 900 is input to the stream data processing unit 100 through the query registration interface 202, so that the execution tree for realizing the basic process units 910, 920, 930, and 940 is generated.

The query 910 counts the number of accumulated speeches during the meeting from the result of the query 830. First of all, the query 910 generates relations in which the value of the name column is switched every time a speech starting tuple is generated by the window operator "[ROWS 1]". However, if the speech starting tuples of the same speaker continue, the relations are not switched. The relations are converted into a stream by the streaming operator "ISTREAM", so that the speech starting time when a speaker is changed for another is extracted. Further, the streams are perpetuated by the window operator "[UNBOUNDED]", grouped by the name column, counted by the aggregation operator "COUNT", so that the number of accumulated speeches for each speaker is calculated.

The result (speech_count) of the query for a speech relation 901 is shown as a relation 911. A stream 912 is a result (start_speech) of the query 830 for the relation 901. The relation 913 is a result obtained by processing the stream 912 with the window operator [ROWS 1]. A stream 914 is a result obtained by streaming the relation 913 with IStream. At this time, a stream tuple 917 is generated at the starting time of a tuple 915. However, tuples 915 and 916 have the relation of the same speaker "B", and the ending point of the tuple 915 and the starting point of the tuple 916 coincide with each other (09:08:15), so that a tuple having a starting time of 09:08:15 is not generated. The result obtained by grouping the stream 914 by "name", perpetuating and counting the same is shown as a relation 911. Since the perpetuated relations are counted, the number of speeches is accumulated every time a tuple is generated in the stream 914.

The query 920 calculates a speech time for each speaker for the last 5 minutes from the result of the query 850. First of all, a life cycle of 5 minutes is defined for each tuple on the on-speech stream by the window operator "[RANGE 5 min]", and the tuples are grouped by the name column, and counted by the aggregate operator "COUNT". This process corresponds to counting the number of tuples that have exited on the on_speech stream for the last 5 minutes. The on_speech stream tuples are generated at a rate of 100 pieces per second, so that the number is divided by 100 in the SELECT phrase to calculate a speech time on a second basis.

The query 930 extracts a case where within 3 seconds after a speech made by a speaker, another speaker starts to make a speech, as a conversation between two participants from the results of the queries 830 and 840. The life cycle of each tuple on the stop_speech stream and the start_speech stream is defined by the window operator "[RANGE 3 sec]" and "[NOW]", respectively, and combinations in which the start-speech tuple is generated within 3 seconds after the stop_speech tuples are generated are extracted by the join operator relating to the name column (on the condition that the name columns do not coincide with each other). The result is output by projecting stop_speech.name to the pre column and projecting start_speech.name to the post column. The result (speech_sequence) of the query for the speech relation 901 is shown as a stream 931. A stream 932 is a result (stop_speech) of the query 840 for the relation 901, and a relation 933 is in an intermediate state in which a life cycle of 3 seconds is defined for each tuple on the stream 932. The result obtained by converting the stream 912 into a relation with the NOW window is the same as the stream 912. The result obtained by streaming the result of the join operator between the relation and the relation 933 with IStream is shown as the stream 931.

The query 940 counts the number of accumulated conversations during the meeting for each combination of two participants from the result of the query 930. The stream 931 is perpetuated by the window operator "[UNBOUNDED]", grouped for each combination of the pre column and the post column by "Group by pre, post", and counted by the aggregate operator "COUNT". Since the perpetuated relations are counted, the number of conversations is accumulated every time a tuple is generated in the stream 931.

Next, there will be disclosed a method of realizing the basic process units 1000, 1010, and 1020 in the activity data generation 100C by using FIG. 10. The queries 1000, 1010, and 1020 are input to the stream data processing unit 100 through the query registration interface 202, so that the execution tree for realizing the respective basic process units 1000, 1010, and 1020 is generated. These three kinds of queries calculate the heated degree of the meeting. However, the definition of the heated degree differs depending on the queries.

The query 1000 calculates the heated degree as a value obtained by accumulating the values of sound volumes of the all microphones in the stream 1500 (voice) for the last 30 seconds. The query calculates the sum of the values of the energy columns of tuples on the stream 1500 for the last 30 seconds with the window operator "[RANGE 30 sec]" and the aggregate operator "SUM (energy)". In addition, the query 1000 outputs the result every 3 seconds with the streaming operator "RSTREAM[3 sec]" (which also applies to the queries 1010 and 1020). The query 1000 uses the total sum of the speech energies of the participants of the meeting as an index of the heated degree.

The query 1010 calculates the heated degree as a product of the number of speakers and conversations for the last 30 seconds. The heated degree is one concrete example of the discussion activation degree 54 calculated using a product of a total number of speeches and speakers per unit time that is described above. A query 1011 counts the number of tuples of a stream 1514 (speech_sequence) for the last 30 seconds. The relation name of the result of the query is represented as recent_sequences_count. A query 1012 counts the number of tuples of a stream 1511 (start_speech) for the last 30 seconds. The relation name of the result of the query is represented as recent_speakers_count. A query 1013 calculates a product of the both. In the both relations of recent_sequences_count and recent_speakers_count, the number of tuples each having a natural number in the cnt column is always one. Thus, the result of the product of the both is a relation in which just one tuple always exists.

However, if the product is simply calculated by "recent_sequences_count.cnt×recent_speakers_count.cnt", the number of conversations becomes 0 during a period when one speaker makes a speech for a long time, and according the result becomes 0. In order to avoid this, "(recent_sequences_count.cnt+1/(1+recent_sequences_count.cnt))" is used in place of "recent_sequences_count.cnt". Since the portion "+1/(1+recent_sequences_count.cnt)" subsequent to "+" is a quotient of an integer, the result is +1 when recent_sequences_count.cnt is 0, and the result is +0 when recent_sequences_count.cnt is larger than 0. As a result, the heated degree becomes 0 during a silent period when no speakers are present, 1 during a period when one speaker makes a speech for a long time, and a product of the number of speakers and conversations during a period when two or more speakers are present. An index of the heated degree in the query 1010 is determined on the basis of whether the number of participants who participate in the discussion among the participants of the meeting is large and whether opinions are frequently exchanged among the participants.

The query 1020 calculates the heated degree as the motion intensity of the speaker. A query 1021 performs the join operator relating to the name column between a resulting relation obtained by processing the stream 1503 (motion) representing a momentary intensity of motion with the NOW window and a relation 1510 (speech) representing the speech period of the speaker, so that the motion intensity of the participant on speech is extracted. A query 1022 accumulates the motion intensity of the speaker for the last 30 seconds. The query 1020 uses an index of the heated degree on the assumption that the magnitude of motion of the speaker reflects the heated degree of the discussion.

The definition of the heated degree shown herein is an example, and the digitalization of the heated degree of the meeting is data without established definition and relating to human subjectivity, so that it is necessary to search for a definite definition by repeating trials. If computing logic is coded in a procedural language such as C, C# and JAVA (registered trademark) every time a new definition is attempted, the number of development steps becomes numerous. Especially, the code of a logic such as the query 1010 that calculates an index based on an order relation between speeches becomes complicated, and debugging becomes difficult. On the other hand, as in the embodiment described by exemplifying the discussion activation degree and the like, the stream data process is used, so that the definition by a simple declarative query can be realized, thus largely reducing such steps.

Figure 13:
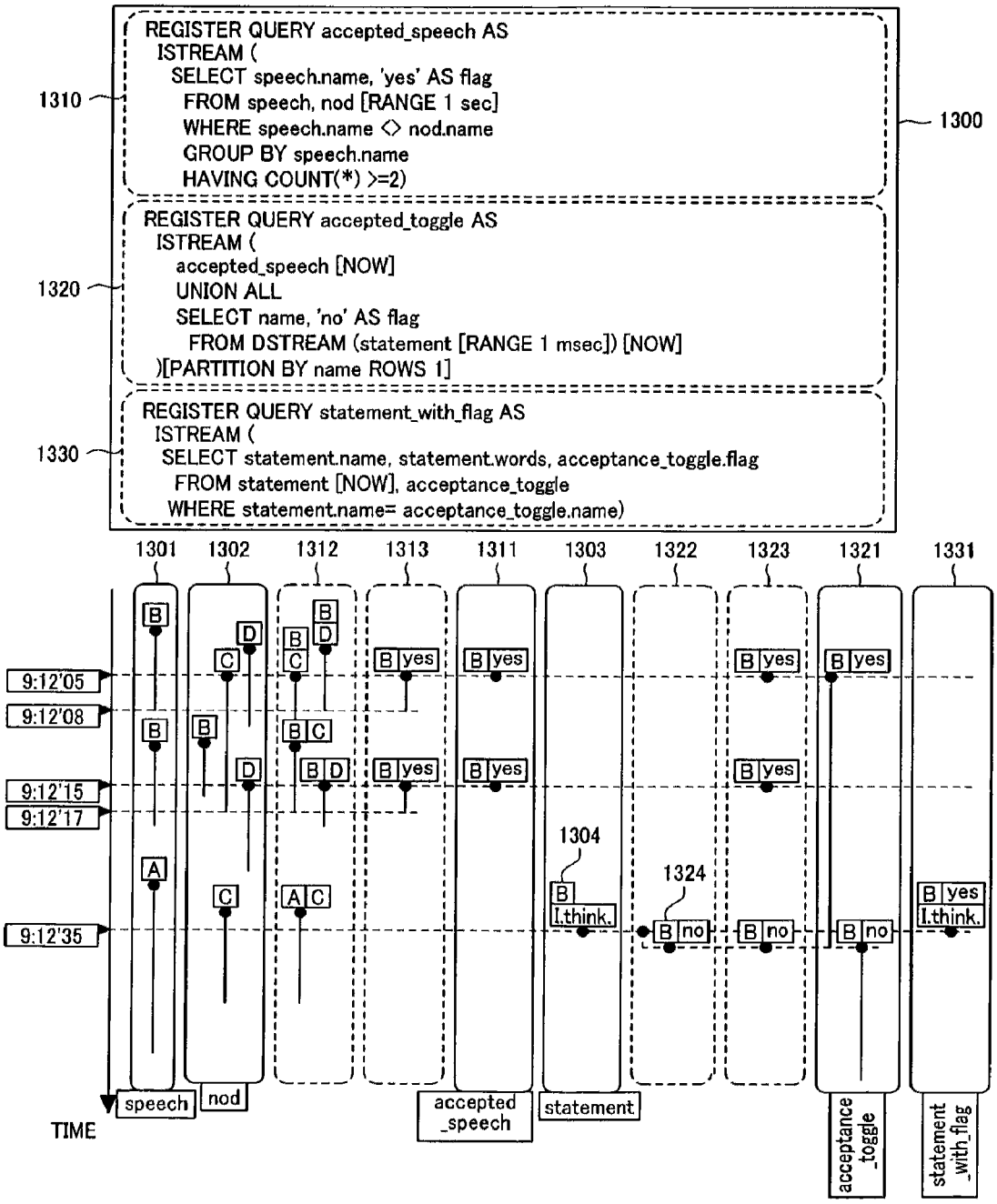
FIG. 13 is a diagram for explaining a configuration for realizing the activity data generation process according to the second embodiment.

Next, there will be disclosed a method of realizing the basic process units 1310, 1320, and 1330 in the activity data generation 100C by using FIG. 13.

A command 1300 is input to the stream data processing unit 100 through the query registration interface 202, so that the execution tree for realizing the basic process units 1310, 1320, and 1330 is generated.

A speech that wins approval from many participants is considered as an important speech during the meeting. In order to extract such a speech, the query 1310 extracts a state in which an opinion of a speaker wins approval from many participants (namely, many participants nod) from the relation 1510 (speech) and the stream 1504 (nod) representing a nodding state. The nodding state can be detected on the basis of an acceleration value measured by the accelerometer 741 included in the name-tag-type sensor node 70 by using a pattern recognition technique. It is assumed in the embodiment that when a participant is nodding at a given time in every one second, a tuple in which the participant name is shown in the name column is generated. A life cycle of one second is defined for each tuple on the stream 1504 by the window operator "[RANGE 1 sec]", so that a relation representing a nodding period for each participant can be obtained (for example, a relation 1302).

The relation and the relation 1510 (for example, a relation 1301) representing a speech period are subjected to the join operator (on the condition that the name columns do not coincide with each other) relating to the name column, so that a relation (for example, a relation 1312) in which a period when participants other than the speaker nod serves as the life cycle of the tuple can be obtained. In the relation, a period when two or more existing tuples are present (namely, two or more participants listen to the speech while nodding) is extracted by the HAVING phrase. At this time, tuples each having the speaker name (speech.name column) and a flag column with the value of a constant character string "yes" are output by the projection operator (for example, a relation 1313). The result is streamed by IStream, and the result of the query 1310 is obtained (for example, a stream 1311). The stream 1311 shows a state in which a tuple is generated at a timing when two participants C and D nod to the speech of the speaker B.

While the query 1310 extracts the occurrence of an important speech, the speech contents are input from the PC 10 as the stream 1505 (statement). Since the speech contents are extracted from the key stokes made by a recording secretary, they are input behind by several tens of seconds compared to the timing of the occurrence of the important speech that is automatically extracted by the voice analysis and the acceleration analysis. On the other hand, the query 1320 and the query 1330 are processes in which after the important speech of a speaker is detected, a flag of the important speech is on for the speech contents of the speaker that are input for the first time.

The query 1320 serves as a toggle switch that holds a flag representing a speech importance degree for each speaker. A resulting relation acceptance_toggle of the query represents whether speech contents input from the stream 1505 (statement) for the next time are important or not for each speaker (for example, a relation 1321). The name column represents the name of a speaker and the flag column represents the importance by using 'yes'/'no'. The query 1330 processes the result obtained by converting the stream 1505 into a relation with the NOW window and the resulting relation of the query 1320 with the join operator relating to the name column, and adds an index of importance to the speech contents for output (for example, a stream 1331).

When the speech contents are input from the stream 1505, the query 1320 generates a tuple for changing the flag of importance relating to the speaker into 'no'. However, the time stamp of the tuple is slightly delayed from the time stamp of the original speech content tuple. This process is defined by a description of "DSTREAM (statement [RANGE 1 msec])". As an example, when a stream tuple 1304 on a statement stream 1303 is input, a stream tuple 1324 whose time stamp is shifted from the stream tuple 1304 by 1 msec is generated on a stream 1322 in an intermediate state. The stream having the 'no' tuple and the result of the query 1310 are merged by the union operator "UNION ALL". As an example, the result obtained by merging the stream 1322 and the stream 1311 is shown as a stream 1323. This stream is converted into a relation by the window operator "PARTITION BY name ROWS 1]". In the window operator, the respective groups divided on the basis of the value of the name column are converted into a relation by the tuple-based window having one tuple existing at the same time. Accordingly, the flag indicates either 'yes' or 'no' of importance for each speaker. As an example, the result obtained by converting the stream 1323 into a relation is shown as the relation 1321. The reason of slightly shifting the time stamp of the 'no' tuple is to avoid joining the 'no' tuple and the original statement tuple itself in the query 1330. Then, the process of the activity data generation 100C is completed.

Next, a screen image obtained by the drawing processing program executed by the display processing unit 203, namely, the processing unit (CPU) of the aggregation server 200 on the basis of the activity data obtained by the activity data generation 100C will be described by using FIGS. 16 and 17.

Figure 16:
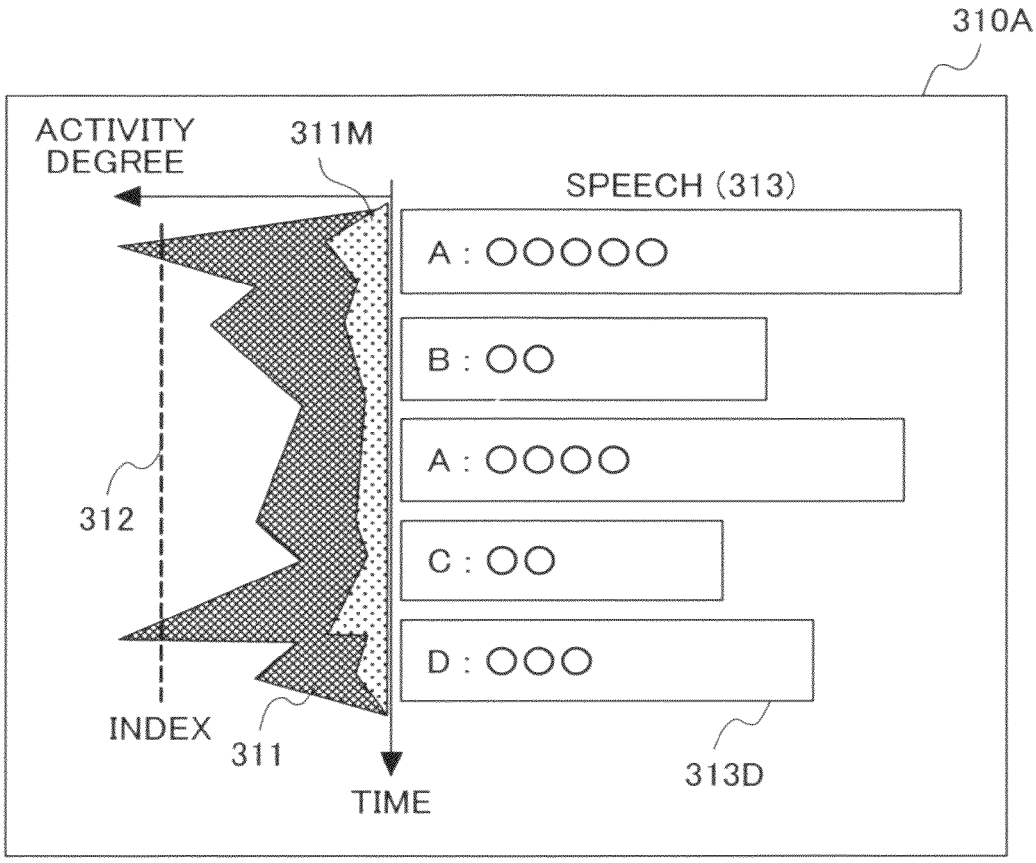
FIG. 16 is a diagram showing another display example of activation degree display of a meeting in the respective embodiments of the meeting visualization system.

FIG. 16 is a screen image in which activity data 1520 based on the motion of a speaker is reflected on an activity degree/speech display 310A as an activity degree 311M of motion. An activity in the meeting can be visualized together with not only the voice but also the action of each member by the screen.

Figure 17:
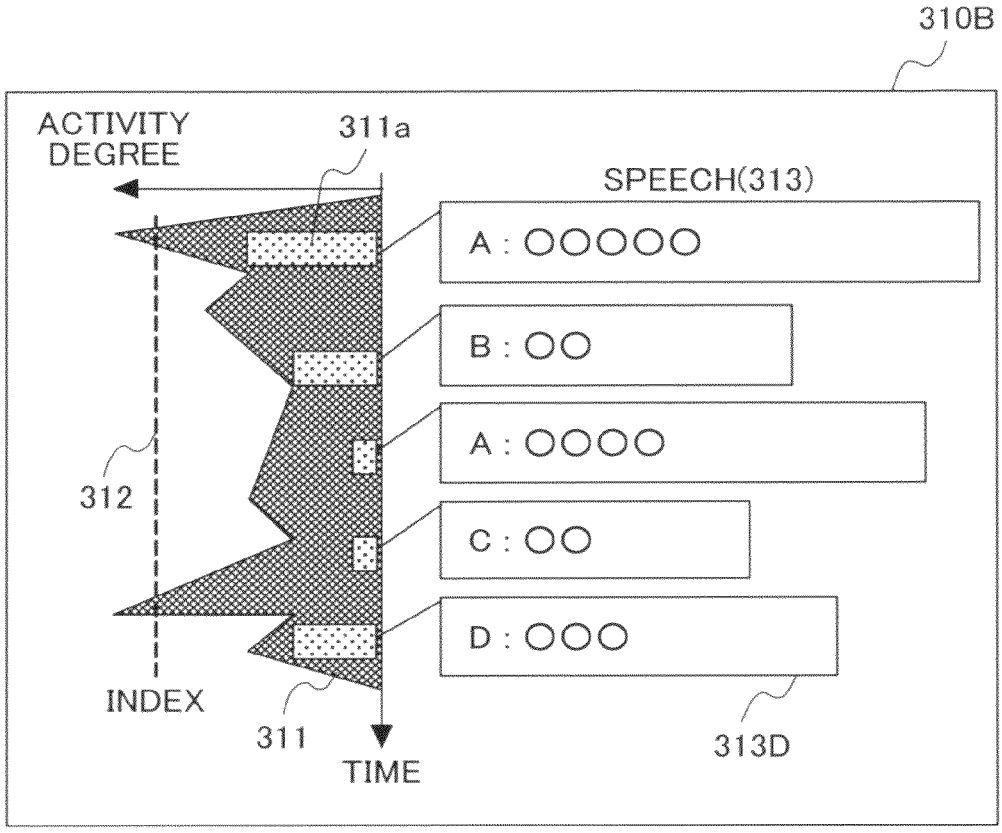
FIG. 17 is a diagram showing another display example of activation degree display of a meeting in the respective embodiments of the meeting visualization system.

Further, FIG. 17 is a screen image in which activity data 1521 representing a speech importance degree measured by nod are reflected on an activity degree/speech display 310B as an index 311*a* of importance speech. The speech 313 of a member and an importance speech index 311*a* are linked and displayed, so that which speech obtains understanding of the participating members can be visualized. As described above, the situations of the meeting can be visualized together with not only the voice but also the understanding degrees of the participating members by the screen.

Figure 14:
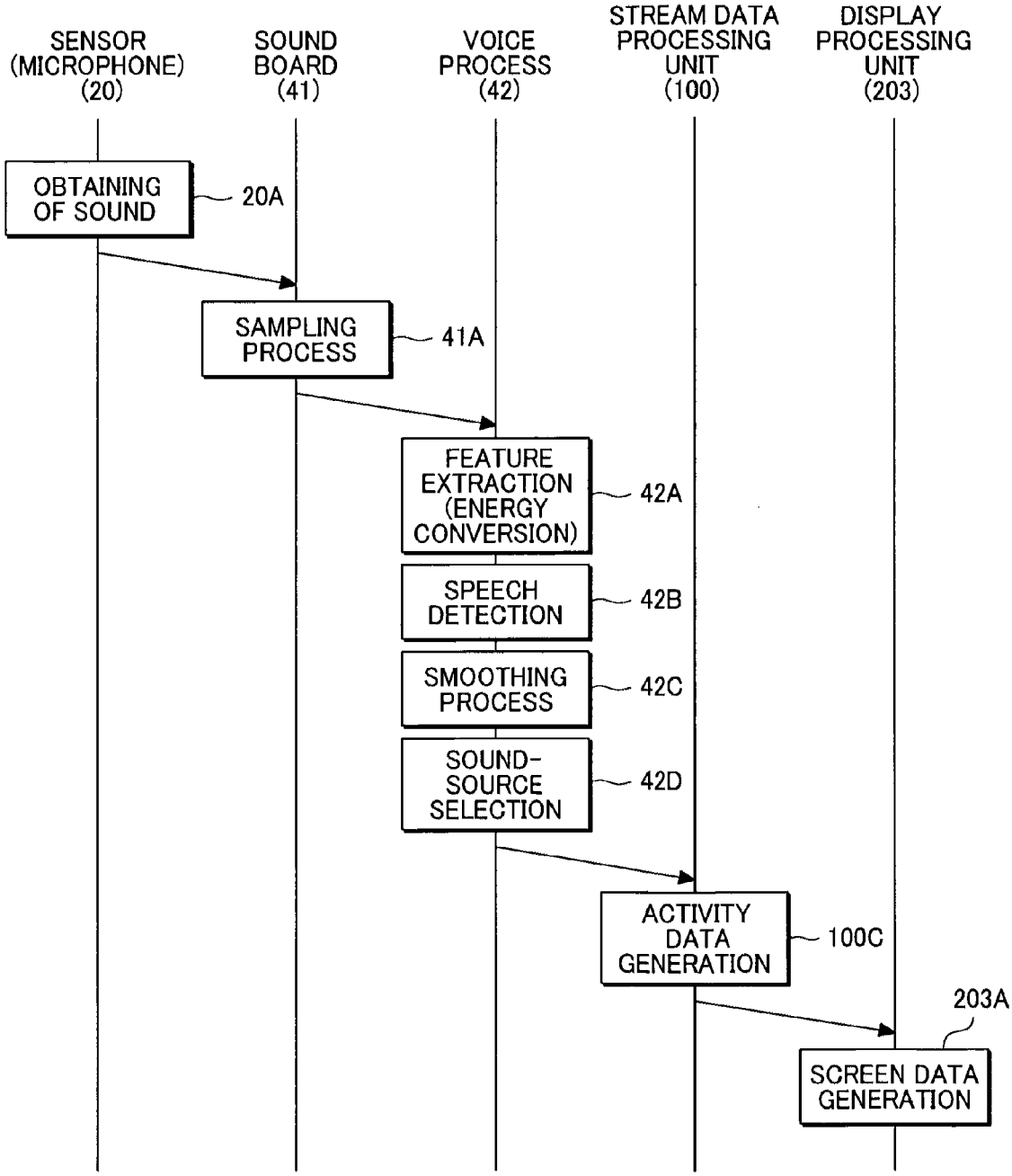
FIG. 14 is a diagram showing another embodiment of a processing sequence of the meeting visualization system.

FIG. 14 is a diagram showing another embodiment of a processing sequence in the function modules shown in FIG. 2. In the processing sequence in this embodiment, after the voice processing unit 42 obtains the feature data, the voice processing server 40 performs a speech detection process, a smoothing process, and a sound-source selection process. These processes are preferably executed as program processing by the processing unit (CPU) (not shown) of the voice processing server 40.

In FIG. 14, voice data is obtained by the sensors (microphones) 20 as similar to FIG. 2 (20A). Next, a sampling process of the voice is performed by the sound board 41 (41A). Next, feature extraction (conversion into energy) is performed by the voice processing unit 42 (42A). The energy is obtained by integrating the square of an absolute value of a sound waveform of a few milliseconds throughout the entire range of the sound waveform.

As the voice process 42 of the voice processing server 40, speech detection is performed on the basis of the feature data obtained by the feature extraction (42A) in the embodiment (42B). A method of discriminating voice from non-voice includes discrimination by using a degree of changes in energy for a few seconds. Voice contains a particular magnitude of sound waveform energy and a particular change pattern, by which voice is discriminated from non-voice.

When using the result obtained by the speech detection for a few seconds as it is, it is difficult to obtain a section of one speech unit as a block of meaning for several tens of seconds. Accordingly, the section of one speech unit is obtained by introducing the smoothing process (42C) so as to be used for the sound-source selection.

The above process is a process to be performed for each sensor (microphone) 20 by the voice process 42, and it is necessary to finally determine the sensor from which (microphone) 20 the voice is input. In the embodiment, a sound-source selection 42D is performed following the smoothing process (42C) in the voice process 42, one sensor (microphone) 20 that receives an actual speech is selected among the sensors (microphones) 20. The voice reaching the nearest sensor (microphone) 20 has a longer section determined as voice than the other sensors (microphones) 20. Thus, the sensor (microphone) 20 having the longest section determined by the result of the smoothing process 42C for the respective sensors (microphones) 20 is output as the result of the sound-source selection 42D in the embodiment. Next, the activity data generation (100C) is performed by the stream data processing unit 100, and finally, the screen data generation (203A) is performed on the basis of the activity data AD by the display processing unit 203, which has been described above.

The invention claimed is:

1. A meeting visualization system which visualizes and displays dialogue situations among a plurality of participants in a meeting, the system comprising:

a plurality of name-tag type sensor nodes that are associated with the participants, each of the name-tag type sensor nodes including an accelerometer for acquiring motion data of the participants;

a key stroke information input unit with which speech contents are input as key stroke information; and a stream processing unit to which the motion data extracted by the name-tag type sensor nodes and the key stroke information extracted by the key stroke information input unit are sequentially input, the stream processing unit associating the motion data with the key stroke information;

wherein the stream processing unit calculates importance of the speech contents based on the motion data.

2. The meeting visualization system of claim 1, wherein the stream processing unit is configured to determine when participants have nodded based on the motion data and calculate the importance of the speech contents based on a quantity of participant nods determined based on the motion data associated with the speech contents.

3. The meeting visualization system of claim 1, further comprising a plurality of voice collecting units that obtain voice data from the participants, and wherein the stream processing unit calculates importance of the voice data based on the motion data.

4. The meeting visualization system of claim 3, wherein the stream processing unit is configured to determine when participants have nodded based on the motion data and calculate the importance of the voice data and the importance of the speech contents based on a quantity of participant nods determined based on the motion data.

* * * * *

UNITED STATES PATENT AND TRADEMARK OFFICE

CERTIFICATE OF CORRECTION

PATENT NO. : 8,290,776 B2
APPLICATION NO. : 12/078520
DATED : October 16, 2012
INVENTOR(S) : Moriwaki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1093 days.

Signed and Sealed this
Ninth Day of September, 2014

Michelle K. Lee

Michelle K. Lee
*Deputy Director of the United States Patent and Trademark Office*